US011161356B2

(12) United States Patent
Kodama et al.

(10) Patent No.: US 11,161,356 B2
(45) Date of Patent: Nov. 2, 2021

(54) TRANSPORTING DEVICE AND PROCESSING DEVICE

(71) Applicant: SEIKO EPSON CORPORATION, Tokyo (JP)

(72) Inventors: Hidetoshi Kodama, Matsumoto (JP); Hirohisa Adachi, Matsukawa-machi (JP); Namiki Hashiguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/064,921

(22) Filed: Oct. 7, 2020

(65) Prior Publication Data

US 2021/0107302 A1 Apr. 15, 2021

(30) Foreign Application Priority Data

Oct. 9, 2019 (JP) ..... JP2019-185948

(51) Int. Cl.
*B65H 9/10* (2006.01)
*B41J 11/00* (2006.01)

(52) U.S. Cl.
CPC ... *B41J 11/0045* (2013.01); *B65H 2404/6111* (2013.01); *B65H 2404/64* (2013.01)

(58) Field of Classification Search
CPC ..... B41J 11/0045; B65H 2515/112; B65H 2404/6112; B65H 2404/6111; B65H 2404/63; B65H 2404/64; B65H 5/36; B65H 9/006; B65H 29/52
See application file for complete search history.

(56) References Cited

U.S. PATENT DOCUMENTS

| | | | | |
|---|---|---|---|---|
| 9,896,291 | B2 * | 2/2018 | Sugiyama | B65H 9/006 |
| 2016/0060058 | A1 | 3/2016 | Sugiyama | |
| 2018/0015747 | A1 | 1/2018 | Kodama et al. | |

FOREIGN PATENT DOCUMENTS

| | | | |
|---|---|---|---|
| JP | H08-113389 | A | 5/1996 |
| JP | 2016-050117 | A | 4/2016 |
| JP | 2017-116748 | A | 6/2017 |
| JP | 2018-016491 | A | 2/2018 |

* cited by examiner

*Primary Examiner* — Huan H Tran
(74) *Attorney, Agent, or Firm* — Workman Nydegger

(57) ABSTRACT

The transporting device includes a transporting path on which a medium recorded by the recording portion is transported in a transporting direction, and a contact portion that comes in contact with a front end of the medium, which is transported through the transporting path, to adjust a transporting state of the medium is adjusted. The transporting path has a guide portion that guides the medium to be transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are configured to move in directions away from each other from the standby position.

19 Claims, 10 Drawing Sheets

TRANSPORTING DEVICE AND PROCESSING DEVICE

The present application is based on, and claims priority from JP Application Serial Number 2019-185948, filed Oct. 9, 2019, the disclosure of which is hereby incorporated by reference here in its entirety.

BACKGROUND

1. Technical Field

The present disclosure relates to a transporting device that transports a medium and a processing device that processes the medium.

2. Related Art

JP-A-2017-116748 discloses a transporting device including a pair of registration rollers as an example of a contact portion in which a front end of a sheet is made to abut as an example of a medium to be transported and a transporting state of the medium is adjusted, and a guide path for guiding the sheet transported between a first guide member having a recess portion and a second guide member having a projection portion facing the recess portion.

In a recording portion of a printing device, a recording is performed on various materials and media of basis weights, and curling may occur on the medium depending on a recording method. For example, in a liquid discharging method as an example of the recording portion of the printing device, for a paper as an example of a printed medium, since a liquid is discharged, the water content of the paper increases, and the unevenness of water due to the printing pattern printed on the paper causes the paper to easily curl.

In a transporting device described in JP-A-2017-116748, the front end of the medium abuts the pair of registration roller by the guide member, and the transporting state is adjusted and transported. However, since a medium with a large basis weight is difficult to bend, in order to make a proper curved shape on the medium so that the skew of the medium is corrected when the front end of the medium abuts the pair of registration rollers, there is a need for a guide path with a relatively long distance and wide interval between the guide members. In the transporting device described in JP-A-2017-116748, since there is no such wide interval in a transporting path, there is a possibility that the ability to correct the skew of a medium having a large basis weight is low.

In the transporting device described in JP-A-2017-116748, a medium with a small basis weight can make a proper curved shape to correct the skew of the medium in a small space with an open guide path immediately in front of the pair of registration rollers and the alignment of the front end of the medium is corrected. However, when the medium having a small basis weight is printed by the liquid discharging method described above, the medium in which the curl is suppressed by the narrow interval part of the guide path curls in the space where the guide path is wide open, and thus the curled part may be caught on the transporting surface of the guide path or the like, and a jam may occur.

SUMMARY

According to an aspect of the present disclosure, to solve the above problems, there is provided a transporting device including a transporting path in which a medium recorded by a recording portion is transported in a transporting direction, and a contact portion that comes in contact with a front end of the medium, which is transported through the transporting path, to adjust a transporting state of the medium, in which the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are provided to be movable in directions away from each other from the standby position.

According to another aspect of the present disclosure, to solve the above problems, there is provided a processing device including a transporting path in which a medium recorded by a recording portion is transported in a transporting direction, and a contact portion that comes in contact with a front end of the medium, which is transported through the transporting path, to adjust a transporting state of the medium, in which the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are provided to be movable in directions away from each other from the standby position.

DESCRIPTION OF EXEMPLARY EMBODIMENTS

Hereinafter, a medium processing system including a transporting device according to an embodiment will be described with reference to the drawings. The medium processing system, for example, discharges an ink, which is an example of a liquid, onto a medium such as a paper, and performs a printing process that records a character or an image on the medium, a skew correction process that corrects a skew of the medium in a transporting procedure of the recorded medium, and a predetermined post-process as an example of a process for the medium in which the skew is corrected.

Outline of Medium Processing System

Figure 1:
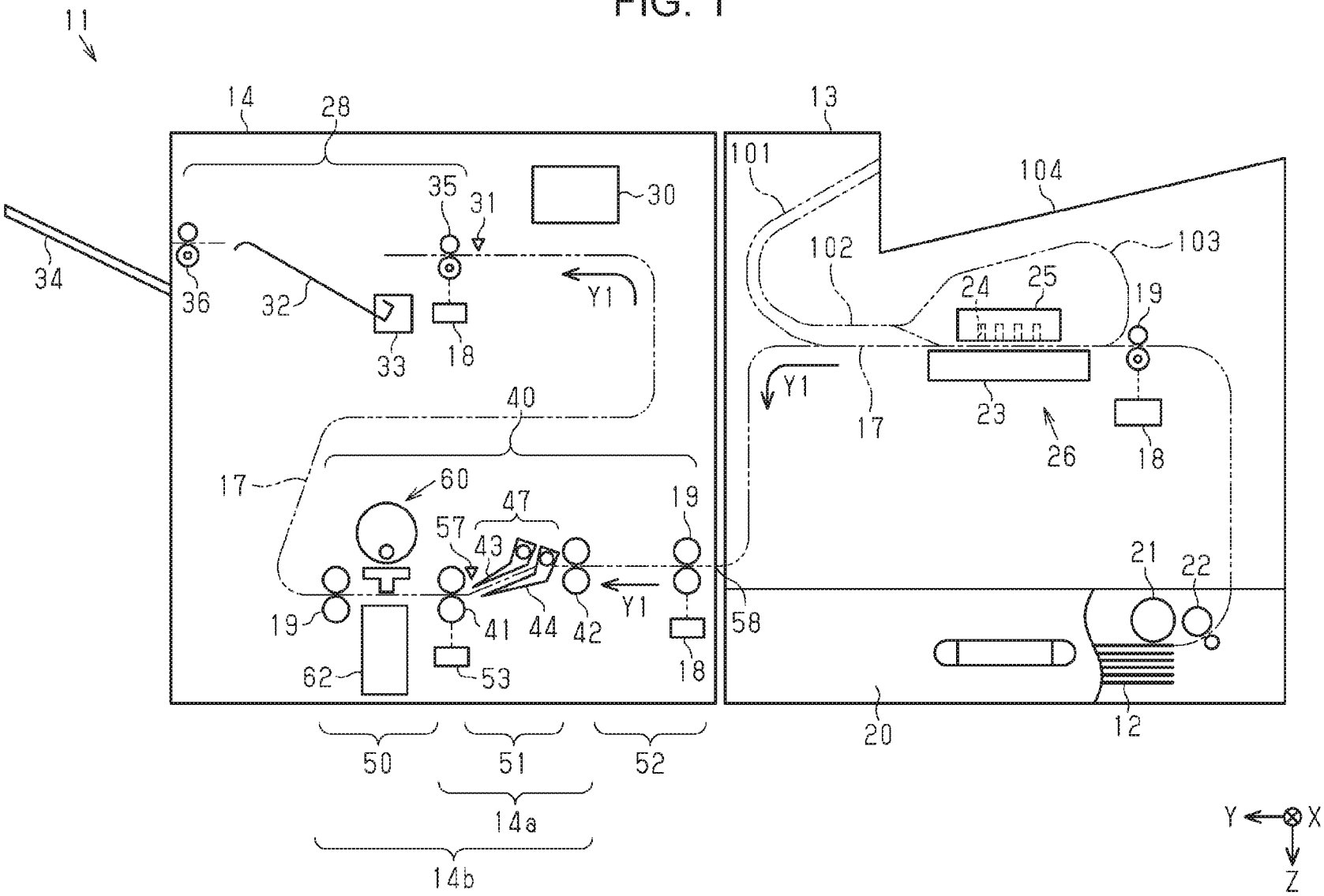
FIG. 1 is a schematic side view illustrating a medium processing system including a transporting device according to an embodiment.

As illustrated in FIG. 1, the medium processing system 11 includes a printing device 13 that records on a medium 12, and a post-processing device 14 that performs a post-process on the recorded medium 12. The printing device 13 is, for example, an ink jet type printer that discharges an ink onto the medium 12 and records a character or an image. The post-processing device 14 performs, as a post-process to be performed on the recorded medium 12, a punching process for punching a hole in the medium 12 for each sheet, a stapling process for binding a plurality of media 12, and the like.

The medium processing system 11 is provided with a transporting path 17 illustrated by a two-dot chain line in FIG. 1 that continues from the printing device 13 to the post-processing device 14. The medium processing system 11 includes one or a plurality of pairs of transporting rollers 19 that transport the medium 12 along the transporting path 17 by driving a transporting motor 18. For the printing device 13 and the post-processing device 14, the transporting motor 18 that drives the pair of transporting rollers 19 may be provided for each device. Further, for the printing device 13 and the post-processing device 14, a plurality of transporting motors 18 may be provided for each device.

In the drawings, the direction of gravity is indicated by the Z axis, and the directions along the surfaces intersecting the Z axis are indicated by the X axis and the Y axis, assuming that the medium processing system 11 is placed on a horizontal plane. The X axis, the Y axis, and the Z axis are desirably orthogonal to each other, and the X axis and the Y axis are along the horizontal plane. In the following description, the X axis direction is also referred to as the width direction X and the Z axis direction is also referred to as the vertical direction Z. A direction orthogonal to the width direction X and along the transporting path 17 is also referred to as a transporting direction Y1. The transporting direction Y1 is a direction in which the medium is transported along the transporting path 17, and changes according to the position on the transporting path 17. A transporting direction of a part of the transporting direction Y1 on which recording is performed on the medium 12 is parallel to the Y axis, and is also referred to as a transporting direction Y.

Overall Configuration of Medium Processing System and Flow of Medium Process

First, the configuration of the printing device 13 and a flow of a medium process will be described.

The printing device 13 is detachably provided with a cassette 20 capable of accommodating the media 12 in a stacked state. A plurality of cassettes 20 may be detachably provided in the printing device 13. Among the media 12 accommodated in the cassette 20, the printing device 13 includes a pickup roller 21 that sends out the uppermost medium 12, and a separating roller 22 that separates the media 12 sent out by the pickup roller 21 one by one.

The printing device 13 includes a recording portion 26. The recording portion 26 has a supporting portion 23 that is provided at a position along the transporting path 17 and supports the medium 12, and a recording head 25 that discharges and records a liquid from a nozzle 24 onto the medium 12 supported by the supporting portion 23. The recording head 25 is provided at a position facing the supporting portion 23 with the transporting path 17 interposed therebetween. The recording head 25 may be a line head capable of discharging the liquid simultaneously over the width direction X, or may be a serial head discharging the liquid while moving in the width direction X.

The printing device 13 includes an exhausting path 101 through which the medium 12 is exhausted as a part of the transporting path 17, a switchback path 102 through which the medium 12 is switchback transported, and an inverting path 103 in which a posture of the medium 12 is inverted. The medium 12 recorded by the recording head 25 is exhausted to an exhausting portion 104 through the exhausting path 101.

When a double-sided printing is performed, the medium 12 recorded on one side is transported to the switchback path 102, thereafter, transported in the reverse direction, and transported from the switchback path 102 to the inverting path 103. The medium 12 inverted in the inverting path 103 is fed again to the recording head 25, and is recorded, by the recording head 25, on a surface opposite to the surface already recorded. In this way, the printing device 13 performs the double-sided printing on the medium 12. The printing device 13 transports the recorded medium 12 toward the exhausting portion 104 or the post-processing device 14. That is, the printing device 13 exhausts the recorded medium 12 to the exhausting portion 104 when no post-process instruction is given, and transports the recorded medium 12 toward the post-processing device 14 when a post-process instruction is given. The post-process in the present embodiment includes a process in which processing on the medium 12 is performed, such as a punching process and a stapling process, and a process in which processing on the medium 12 is not performed, such as an offset process where the medium 12 is shifted to the left or right one by one.

Next, the configuration of the post-processing device 14 and a flow of a medium process will be described.

Figure 2:
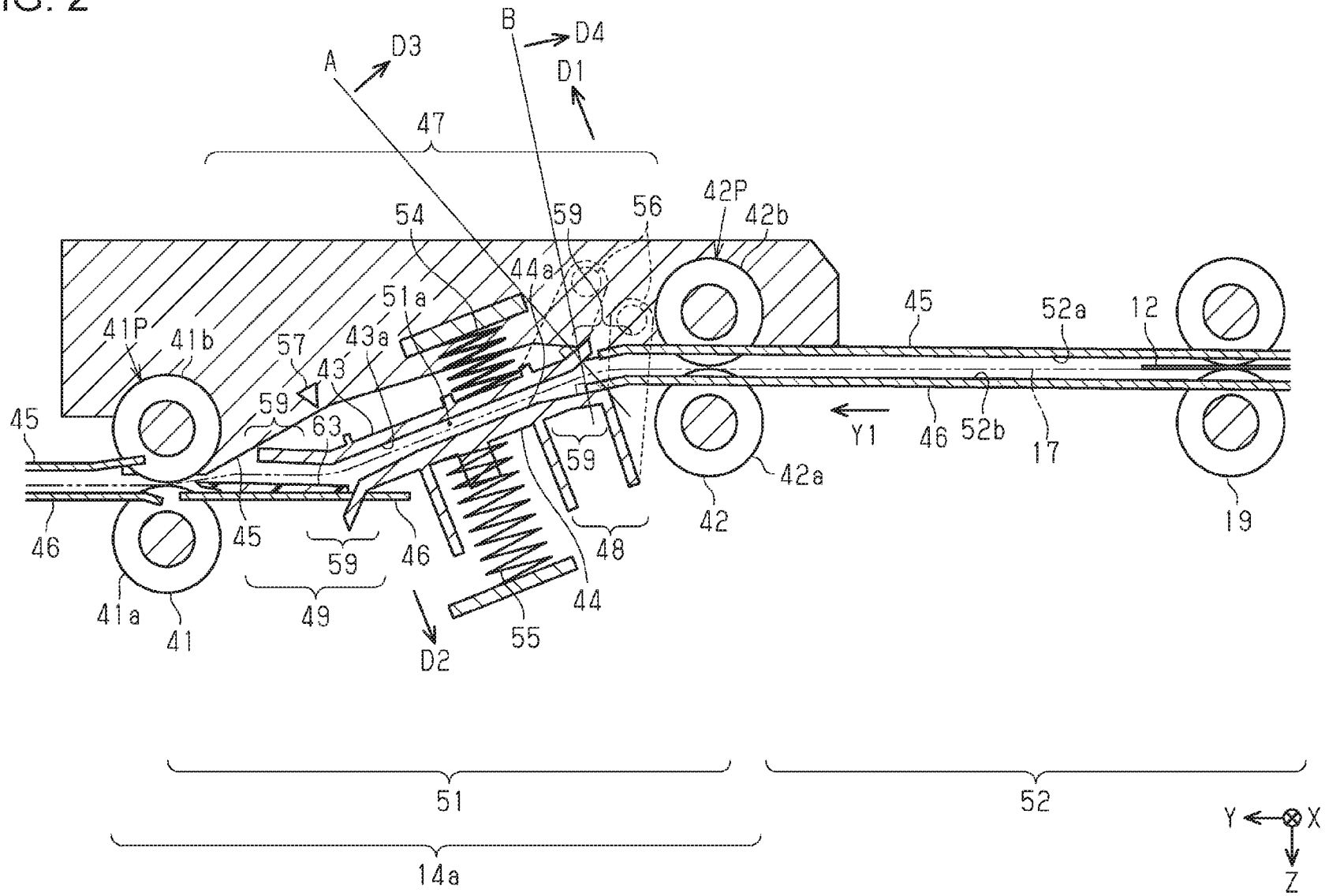
FIG. 2 is a schematic cross-sectional view illustrating a state when a medium is not transported by the transporting device.

As illustrated in FIG. 1, the post-processing device 14 includes a first medium processing device 40 that performs a first process for each sheet with respect to the medium 12 carried in by the printing device 13, and a second medium processing device 28 that performs a second process with respect to the medium 12 that has passed through the first medium processing device 40. The post-processing device 14 includes a plurality of pairs of transporting rollers 19 that transport the medium 12 along the transporting path 17 by driving the transporting motor 18. The first medium processing device 40 includes a medium supplying portion 42 that supplies the recorded medium 12 along the transporting path 17 when the skew correction process is performed, and a contact portion 41 that abuts the front end of the medium 12 supplied from the medium supplying portion 42 to make contact. As illustrated in FIG. 2, the medium supplying portion 42 is constituted by a pair of transporting rollers 42P. Further, the contact portion 41 is constituted by a pair of transporting rollers 41P. The pair of transporting rollers 42P is driven by the transporting motor 18 together with the pair of transporting rollers 19 positioned upstream in the transporting direction Y1. The pair of transporting rollers 41P is stopped from rotating during the alignment correction process of the front end of the medium 12, and functions as a contact portion 41 in which the front end of the medium 12 abuts a nip portion of the pair of transporting rollers 41P which is stopped. The pair of transporting rollers 41P is driven by a contact portion driving motor 53 that is a driving source different from the transporting motor 18 that is the driving source of the pair of transporting rollers 42P. Further, the post-processing device 14 includes a control portion 30 that drives and controls the first medium processing device 40 and the second medium processing device 28.

In the present embodiment, in the transporting path 17 of the first medium processing device 40, the medium 12 recorded by the recording portion 26 is transported in the transporting direction Y1. The first medium processing device 40 includes an upstream transporting path 52 that carries the recorded medium 12 exhausted from the printing device 13 into the post-processing device 14, a transporting device 14*a* that corrects the skew of the medium 12 sent from the upstream transporting path 52, and a punching processing portion 50 as an example of a processing portion that performs the process with respect to the skew-corrected medium 12 sent out from the transporting device 14*a*. The transporting path 17 of the transporting device 14*a* includes the above-described medium supplying portion 42, a curved transporting path 51, and the contact portion 41. The curved transporting path 51 allows the medium 12 to be curved when the front end of the medium 12 transported from the medium supplying portion 42 along the transporting path 17 abuts on the contact portion 41. The front end of the medium 12 follows the width direction X along the nip portion of the pair of transporting rollers 41P by utilizing a restoring force that the medium 12 curved in the curved transporting path 51 restores to the original posture. That is, the front end of the medium 12 abuts the nip portion of the pair of transporting rollers 41P, and thus the alignment of the front end of the medium 12 is corrected. Hereinafter, a state in which the front end of the medium 12 contacts the nip portion of the pair of transporting rollers 41P and follows the width direction X along the nip portion is referred to as "abutment". The punching processing portion 50 is provided on the transporting path 17 downstream of the contact portion 41, which is included in the transporting device 14*a*, in the transporting direction, and performs a process of punching a punching hole, which is used when binding to a binder or the like, with respect to the medium 12 that has passed through the contact portion 41. The punching processing portion 50 is disposed below the post-processing device 14 so that the punch dust and paper dust generated during the punching process do not fall into the transporting path 17.

As illustrated in FIG. 1, the first medium processing device 40 corrects the skew of the medium 12 carried in from the printing device 13 by the curved transporting path 51 of the transporting device 14*a*, and the punching processing portion 50 punches a punching hole in the rear end of the medium 12 in which the skew is corrected. In the present embodiment, the transporting device 14*a* and the punching processing portion 50 constitute the processing device 14*b*.

In the transporting path 17 of the post-processing device 14 of the present embodiment, at a distance interval that allows the medium 12 having the minimum length in the transporting direction Y1 to be transported, the pair of transporting rollers 19, the medium supplying portion 42, the contact portion 41, an intermediate discharging roller 35, and other medium transporting elements (not illustrated) are disposed. In the present embodiment, in the transporting path 17, the medium transporting elements are disposed at a pitch slightly shorter than the length of the medium 12 having the smallest length in the transporting direction Y1. For example, when the A5 size (148 mm×210 mm) is the smallest size of the medium 12, the medium transporting elements are disposed at a pitch of 120 mm to 135 mm in the transporting path 17.

As illustrated in FIG. 1, in the present embodiment, in the transporting path 17, the pair of transporting rollers 19 of the upstream transporting path 52, the medium supplying portion 42, and the contact portion 41 are disposed on a path along the transporting direction Y1. The upstream transporting path 52 transports the medium 12 even when a part of the medium 12 is positioned in the transporting path 17 that is in a range from the pair of transporting rollers 19 near a carry-in port 58 to the medium supplying portion 42. The transporting device 14*a* transports the medium 12 even when a part of the medium 12 is positioned in the curved transporting path 51 that is in a range from the medium supplying portion 42 to the contact portion 41 in the transporting path 17. In the present embodiment, a part of the transporting path 17, which is upstream of the medium supplying portion 42, has the medium supplying portion 42 as a starting point, and has the same length as the curved transporting path 51, is an upstream transporting path 52. That is, the length of the upstream transporting path 52 along the transporting path 17 has the same length as that of the curved transporting path 51.

As illustrated in FIG. 1, the transporting path 17 continues from the pair of transporting rollers 19 positioned downstream of the punching processing portion 50 to the intermediate discharging roller 35, and the second medium processing device 28 is disposed in the middle thereof. One or a plurality of other medium processing devices may be disposed in the middle of the transporting path 17 between the first medium processing device 40 and the second medium processing device 28. In this case, other post-processes other than the punching process and the stapling process are performed on the medium 12 by other medium processing devices.

As illustrated in FIG. 1, the second medium processing device 28 includes the intermediate discharging roller 35 that exhausts the medium 12 to the intermediate stacker 32, an intermediate stacker 32 that stacks the medium 12 transported by the intermediate discharging roller 35, and a detection portion 31 that detects the rear end of the medium 12.

The detection portion 31 is disposed at a position slightly upstream of the intermediate discharging roller 35 in the transporting direction Y. After the detection portion 31 detects the rear end of the medium 12 and the rear end of the medium 12 passes the intermediate discharging roller 35, the control portion 30 drives a medium dropping mechanism (not illustrated) which is disposed above the intermediate stacker 32 to drop the medium 12 onto the intermediate stacker 32. The medium dropping mechanism is, for example, a flap mechanism including a revolving flap that knocks off the medium 12 in flight immediately after the rear end of the medium 12 is exhausted from the intermediate discharging roller 35.

The second medium processing device 28 includes a post-processing mechanism 33 that performs a post-process on the media 12 stacked on the intermediate stacker 32, an discharging roller 36 that exhausts a bundle of post-processed media 12 from the intermediate stacker 32 to the outside of the post-processing device 14, and an exhausting stacker 34 that stacks the bundle of media 12 exhausted from the intermediate stacker 32 by the discharging roller 36.

As illustrated in FIG. 1, in the second medium processing device 28, when the rear end of the medium 12 transported from the first medium processing device 40 passes the intermediate discharging roller 35, the medium 12 is dropped onto the intermediate stacker 32 by driving the medium dropping mechanism (not illustrated). Since the intermediate stacker 32 is disposed in an inclined posture that is inclined in a direction in which the upstream end is positioned below the vertical direction Z than the downstream end in the transporting direction Y1, the medium 12 dropped on the intermediate stacker 32 slides down on the upper surface of the intermediate stacker 32 toward the upstream in the transporting direction Y1 due to gravity. The rear end of the slid medium 12 extends from the upstream end portion of the intermediate stacker 32 in the transporting direction Y1 and contacts with a matching portion having a bending shape at a right angle, and thus the rear ends of the media 12 are aligned. For example, a raking member such as a paddle that assists the movement of the medium 12 to the upstream in the transporting direction Y1 may be provided above the intermediate stacker 32.

The media 12 that has passed through the intermediate discharging roller 35 are stacked on the intermediate stacker 32 one after another. When the number of media 12 designated by a user is stacked on the intermediate stacker 32, the post-processing mechanism 33 performs the post-process on the bundle of stacked media 12. For example, the stapling process is performed with respect to the bundle of stacked media 12 at a binding position designated by the user. The bundle of the media 12 in which the post-process is performed, is exhausted from above the intermediate stacker 32 by the discharging roller 36 on the exhausting stacker 34 disposed so as to be able to move up and down along the outer surface of the post-processing device 14. The bundle of the media 12 in which the post-process is performed is sequentially stacked on the exhausting stacker 34. The second medium processing device 28 can offset the bundle of media 12, which is stacked by the intermediate stacker 32, at a position different from the bundle of the previously exhausted media 12 in the width direction X by driving an offset mechanism (not illustrated), and an offset process or the like, in which the bundle of the media 12 is exhausted onto the exhausting stacker 34 and shifted in the width direction X one by one, may be also performed instead of or in addition to the stapling process.

Configuration of First Medium Processing Device

Next, a detailed configuration of the transporting device 14*a* will be described with reference to FIG. 2.

As illustrated in FIG. 2, the upstream transporting path 52 is constituted by the pair of transporting rollers 19 that carries the recorded medium 12 into the post-processing device 14, and the transporting path 17 from the carry-in port 58 (see FIG. 1) of the medium 12 to the medium supplying portion 42. When a notification that the recording on the medium 12, which is exhausted from the control portion (not illustrated) on the printing device 13 side to the post-processing device 14, has started is received, the control portion 30 drives the transporting motor 18 to rotate the pair of transporting rollers 19. In the transporting path 17 in the post-processing device 14, the medium 12 in which the recording is performed by the recording portion 26 is transported in the transporting direction Y1.

In the transporting path 17 of the post-processing device 14, the curved transporting path 51 is disposed downstream of the upstream transporting path 52. The curved transporting path 51 has a contact portion 41 that comes in contact with the front end of the medium 12, which is transported through the transporting path 17, to adjust the transporting state of the medium 12, a guide portion 47 that guides the transported medium 12 to the contact portion 41, and a sensor 57. The guide portion 47 has a first guide portion 43 that is swingable, and a second guide portion 44 that faces the first guide portion 43 and is swingable. The first guide portion 43 and the second guide portion 44 are disposed at a standby position when the medium 12 is not transported through the transporting path 17, and are provided so as to be movable in a direction away from each other from the standby position. The sensor 57 detects the front end of the medium 12 carried into the post-processing device 14, and also detects the rear end of the medium 12 that has passed through the sensor 57 for performing the punching process.

In the present embodiment, the contact portion 41 is constituted by the pair of transporting rollers 41P having a driving roller 41*a* and a driven roller 41*b* capable of transporting with the medium 12 interposed therebetween. The guide portion 47 has a leading member 63 immediately in front of the contact portion 41. The leading member 63 is formed of a plastic, a resin film, or the like, and is formed in a shape in which the front end of the medium 12 is led to the nip portion of the pair of transporting rollers 41P when the front end of the medium 12 abuts the leading member 63.

As illustrated in FIG. 2, the medium supplying portion 42 abuts the front end of the medium 12 supplied along the pair of transporting rollers 42P against the nip portion of the pair of transporting rollers 41P that has stopped rotating. Due to the restoring force of the medium 12 curved by the abutment to return to the original state, the alignment of the front end of the medium 12 is corrected along the nip portion of the pair of transporting rollers 41P. The distortion due to the twist between the front end alignment and the rear end alignment is absorbed by the curved shape part of the medium 12. By rotating the pair of transporting rollers 41P by the contact portion driving motor 53, the control portion 30 passes the pair of transporting rollers 41P in a state where the alignment of the front end of the medium 12 is corrected, and thereafter passes the pair of transporting rollers 41P in a state where the alignment of the rear end of the medium 12 is corrected. In this way, the skew of the medium 12 is corrected. The medium 12 in which the skew is corrected is transported from the transporting device 14*a* to the punching processing portion 50.

In the case of the medium 12 having a large basis weight, when the medium supplying portion 42 abuts the front end of the medium 12 against the nip portion of the pair of transporting rollers 41P of the contact portion 41, the nip force of the pair of transporting rollers 41P may lose to the pushing force generated by the curved part of the medium 12, and the front end portion of the medium 12 may enter between the nips of the pair of transporting rollers 41P. In this case, it becomes difficult to form a curved shape suitable for the skew correction on the medium 12. Therefore, the contact portion 41 and the medium supplying portion 42 are set to have a nip force that is several times that of other transporting rollers. The pair of transporting rollers 41P is set to a nip force that does not enter between the nips of the pair of transporting rollers 41P when abutting the front end portion of the medium 12, and the pair of transporting rollers 42P is set to a nip force such that the front surface and the back surface of the medium 12 do not slip between the nips of the pair of transporting rollers 42P.

As an example of the contact portion 41 other than the pair of transporting rollers 41P, for example, there is a method in which the medium supplying portion 42 abuts the front end of the medium 12 on a wall, alignment of the front end of the medium 12 and the alignment of the wall coincide with each other, and thereafter the skew is corrected by the medium 12 being transported.

As illustrated in FIG. 2, the transporting device 14*a* includes the medium supplying portion 42 provided on the upstream of the guide portion 47 in the transporting direction Y. The curved transporting path 51 is a part of the transporting path 17 that extends from the medium supplying portion 42 to the contact portion 41. The curved transporting path 51 has a first curved path 48 curved in a direction in which the medium 12 is curved to the first direction D1 side, and a second curved path 49 positioned downstream of the first curved path 48 in the transporting direction Y1 and curved in a direction in which the medium 12 is curved to the second direction D2 side, which is the direction opposite to the first direction D1. The first curved path 48 is at a position closer to the medium supplying portion 42 than the second curved path 49. The first guide portion 43 is provided on the first curved path 48 on the first direction D1 side.

The medium supplying portion 42 may be, for example, a rotating body such as a belt as long as it can send out the medium 12. However, the medium supplying portion 42 receives the pushing force of the curved part that is formed when the front end of the medium 12 abuts the contact portion 41. Since the medium supplying portion 42 needs a transporting force that does not slip with respect to the medium supplying portion 42, the medium supplying portion 42 is formed of a pair of transporting rollers in the present embodiment.

As illustrated in FIG. 2, the curved transporting path 51 and the upstream transporting path 52 have a first transporting surface 45 that contacts when the medium 12 that is transported on the transporting path 17 approaches the first direction D1 side, and a second transporting surface 46 that contacts when the medium 12 that is transported on the transporting path 17 approaches the second direction D2 side. The guide portion 47 of the curved transporting path 51 has a part of the first transporting surface 45 and a part of the second transporting surface 46. That is, in a state where a pair of guide portions 43 and 44 are positioned at a standby position, the curved transporting path 51 has a first curved path 48, a linear shape of intermediate path 51*a* interposed between the pair of guide portions 43 and 44, and a second curved path 49, in the range from the medium supplying portion 42 to the contact portion 41 and at the order from upstream to downstream.

As illustrated in FIG. 2, the first curved path 48 extends substantially horizontally from the nip position of the pair of transporting rollers 42P to the downstream in the transporting direction Y1, and is curved so as to be a projection shape toward the first direction D1 side so that the downstream end thereof is connected to the upstream ends of the pair of guide portions 43 and 44. The intermediate path 51*a* is a linear shape transporting path that is interposed between the pair of guide portions 43 and 44, and is inclined at a predetermined angle with respect to the horizontal. The second curved path 49 extends substantially horizontally from the nip position of the pair of transporting rollers 41P to the upstream in the transporting direction Y1, and is curved so as to be a projection shape toward the second direction D2 side so that the upstream end thereof is connected to the downstream ends of the pair of guide portions 43 and 44. In the side view illustrated in FIG. 2, the curved transporting path 51 is an S shape transporting path with the first curved path 48, the intermediate path 51*a*, and the second curved path 49.

Further, on the upstream of the nip position of the pair of transporting rollers 42P in the transporting direction Y1, the upstream transporting path 52 has a first transporting surface 52*a* constituting a part of the first transporting surface 45 and a second transporting surface 52*b* constituting a part of the second transporting surface 46.

As illustrated in FIG. 2, the first guide portion 43 is urged by a first urging member 54 in a direction approaching the second guide portion 44. The first guide portion 43 has a guide surface 43*a* that constitutes a part of the first transporting surface 45. The swing center 56 of the first guide portion 43 is provided at a position closer to the upstream end than the downstream end of the first guide portion 43 in the transporting direction Y1, and a position opposite to the side where the second guide portion 44 is positioned with respect to the guide surface 43*a*. In the first guide portion 43 at the standby position such that the first guide portion 43 swings only in the first direction D1 side when the medium 12 contacts the first guide portion 43, the swing center 56 of the first guide portion 43 is desirably provided at a position to be a third direction D3 side than a perpendicular line A passing through the contact position of the guide surface 43*a* with which the medium 12 to be transported first contacts.

The second guide portion 44 is urged by a second urging member 55 in a direction approaching the first guide portion 43. The second guide portion 44 has a guide surface 44*a* that constitutes a part of the second transporting surface 46. The swing center 56 of the second guide portion 44 is provided at a position closer to the upstream end of the second guide portion 44 than the downstream end in the transporting direction Y1, and on the side where the first guide portion 43 is positioned. Further, it is desirable that the swing center 56 of the second guide portion 44 is at the position such that the guide surface 44*a* of the swinging second guide portion 44 does not come out to the first direction D1 side from the guide surface 44*a* of the second guide portion 44 at the standby position, and in the present embodiment, it is also desirable that the swing center 56 of the second guide portion 44 is on a fourth direction D4 side from a perpendicular line B passing through the position of the guide surface 44*a* where the transporting path is switched to the second guide portion 44 in the first curved path 48. The intermediate path 51*a* is formed between the guide surface 43*a* included in the first guide portion 43 and the guide surface 44*a* included in the second guide portion 44.

As illustrated in FIG. 2, an average value of a distance between the first transporting surface 45 and the second transporting surface 46 when the first guide portion 43 and the second guide portion 44 of the curved transporting path 51 are both positioned at the standby position, is set to be equal to or less than an average value of a distance between the first transporting surface 45 and the second transporting surface 46 of the upstream transporting path 52.

In the curved transporting path 51, since a part of the first transporting surface 45 is constituted by the first guide portion 43 and a part of the second transporting surface 46 is constituted by the second guide portion 44, the distance between the first transporting surface 45 and the second transporting surface 46 is not strictly uniform, but they are substantially the same. For example, the difference between the minimum value and the maximum value of the distance with respect to the average value of the distance is within ±10%. In this way, when the first guide portion 43 and the second guide portion 44 are at the standby position, the curved transporting path 51 is set such that the distance between the first transporting surface 45 and the second transporting surface 46 is the same as or shorter than that of the other transporting paths 17. On the other hand, the upstream transporting path 52 is not the transporting path 17 on which the process is performed on the medium 12, but the transporting path 17 only for transporting the medium 12.

The printing device 13 of the present embodiment is an ink jet type printer that records a character and an image by discharging ink based on print data with respect to the medium 12 before recording that has bending rigidity determined by type, size, and basis weight. When the printing device 13 records on the medium 12, the water content of the medium 12 changes by attaching the ink. Further, the medium 12 after recording can have a distribution of the water content inside the surface of the medium 12. Therefore, the curl shape and bending rigidity of the medium 12 after recording change depending on the water content and the unevenness of water. The curl shape here includes the direction of curl, the height of curl when the medium 12 is placed on a horizontal plane, a radius of curvature of curl, and the like.

The post-processing device 14 of the present embodiment corresponds to a paper in which a basis weight of paper is 60 gsm to 300 gsm. For the paper transported through the transporting path 17 of the post-processing device 14, the paper is likely to be deformed by an increase in water content due to the ink, and by the unevenness of water due to the printing pattern printed on the paper. Paper of 60 gsm to 90 gsm is a paper that is widely used in general, but the curl with a small radius of curvature is likely to occur at the front end portion of the paper as compared with other recording methods such as a laser method. Since the paper of 300 gsm is thick and the volume of the paper is large with respect to the volume of the ink attached to the paper, the curl hardly occurs even when the water content increases as recorded by an ink jet printer.

In a case where the medium is a paper, when the paper texture direction is parallel to the transporting direction, the rigidity in the direction orthogonal to the transporting direction becomes small, and the curl at the side end easily occurs. When the paper texture direction is orthogonal to the transporting direction, the rigidity in the transporting direction becomes small and the curl at the front end easily occurs. That is, for the paper in which the basis weight of the paper is small and the paper texture direction is orthogonal to the transporting direction, the curl at the front end of the paper becomes extremely large when the recording is performed on only one side of the front end portion of the paper.

As illustrated in FIG. 2, the distance between the first transporting surface 45 and the second transporting surface 46 of the curved transporting path 51 when the first guide portion 43 and the second guide portion 44 are positioned at the standby position is within 5 mm. In the curved transporting path 51, a part of the first transporting surface 45 is constituted by the first guide portion 43, and a part of the second transporting surface 46 is constituted by the second guide portion 44. Therefore, in the curved transporting path 51, there is a seam 59 of the transporting surfaces 45 and 46 at both end portions of the pair of guide portions 43 and 44 in the transporting direction Y1.

For example, at the seam 59 with the first transporting surface 45 on the side closer to the downstream of the first guide portion 43, the distance between the transporting surfaces 45 and 46 is slightly larger than the surroundings. The distance between the transporting surfaces 45 and 46 needs to be set short in order to transport the medium 12 while suppressing the curling of the medium 12, but at the seam 59, the distance between the transporting surfaces 45 and 46 becomes wider than the surroundings. When the medium 12 having a certain amount of curl and having a large basis weight is transported, the resistance between the front end part of the medium 12 having the curl and the transporting surfaces 45 and 46 may increase, and the skew or jam of the medium 12 may occur. When the resistance to the transporting surfaces 45 and 46 is large, the torque required to transport the medium 12 is also large. Therefore, in order to suppress the curl of the front end part of the medium 12 and keep the resistance between the front end part and the transporting surfaces 45 and 46 small, both end portions of the pair of guide portions 43 and 44 in the transporting direction Y1 are shaped so that the distance between the transporting surfaces 45 and 46 can be minimized even at the seam 59.

For example, for the paper with a basis weight of up to 300 gsm, in consideration of the curl at the front end portion or ripples on the entire paper, and in order not to increase the transporting resistance and to prevent jams, the distance between the first transporting surface 45 and the second transporting surface 46 is desirably set within a range of 3 mm to 4 mm. However, even when a designer designs the distance to be up to 4 mm, there may be a case where the actual device slightly exceeds 4 mm due to variations in the dimensions of each component, assembly errors, and the like.

As illustrated in FIG. 2, in order to correspond to the basis weight of the medium 12 in a wide range, the load that causes the first guide portion 43 at the standby position to swing in a direction away from the second guide portion 44 is set larger than the load that causes the second guide portion 44 at the standby position to swing in a direction away from the first guide portion 43. That is, in the medium 12 having a small basis weight, only the second guide portion 44 swings, and in the medium 12 having a large basis weight, both the first guide portion 43 and the second guide portion 44 are set to swing. For example, the first urging member 54 and the second urging member 55 are compressed springs, and the pushing force of the first urging member 54 urging the first guide portion 43 is set to be larger than the pushing force of the second urging member 55 urging the second guide portion 44.

In order to cope with the medium 12 having a large curl caused by an increase in water content due to the ink and the unevenness of water due to the printing pattern printed on the medium 12, the distance between the first transporting surface 45 and the second transporting surface 46 does not widen until the front end of the medium 12 reaches the contact portion 41 in the medium 12 having a small basis weight. That is, in the medium 12 having a small basis weight, it is set such that jam does not occur.

In the medium 12 having a large basis weight in which the curl does not occur, jam does not occur even when the distance between the first transporting surface 45 and the second transporting surface 46 widens. By widening the distance between the first transporting surface 45 and the second transporting surface 46, it is set such that a space for the medium 12 to form a curved part for correcting the skew can be secured between the contact portion 41 and the medium supplying portion 42.

Figure 3:
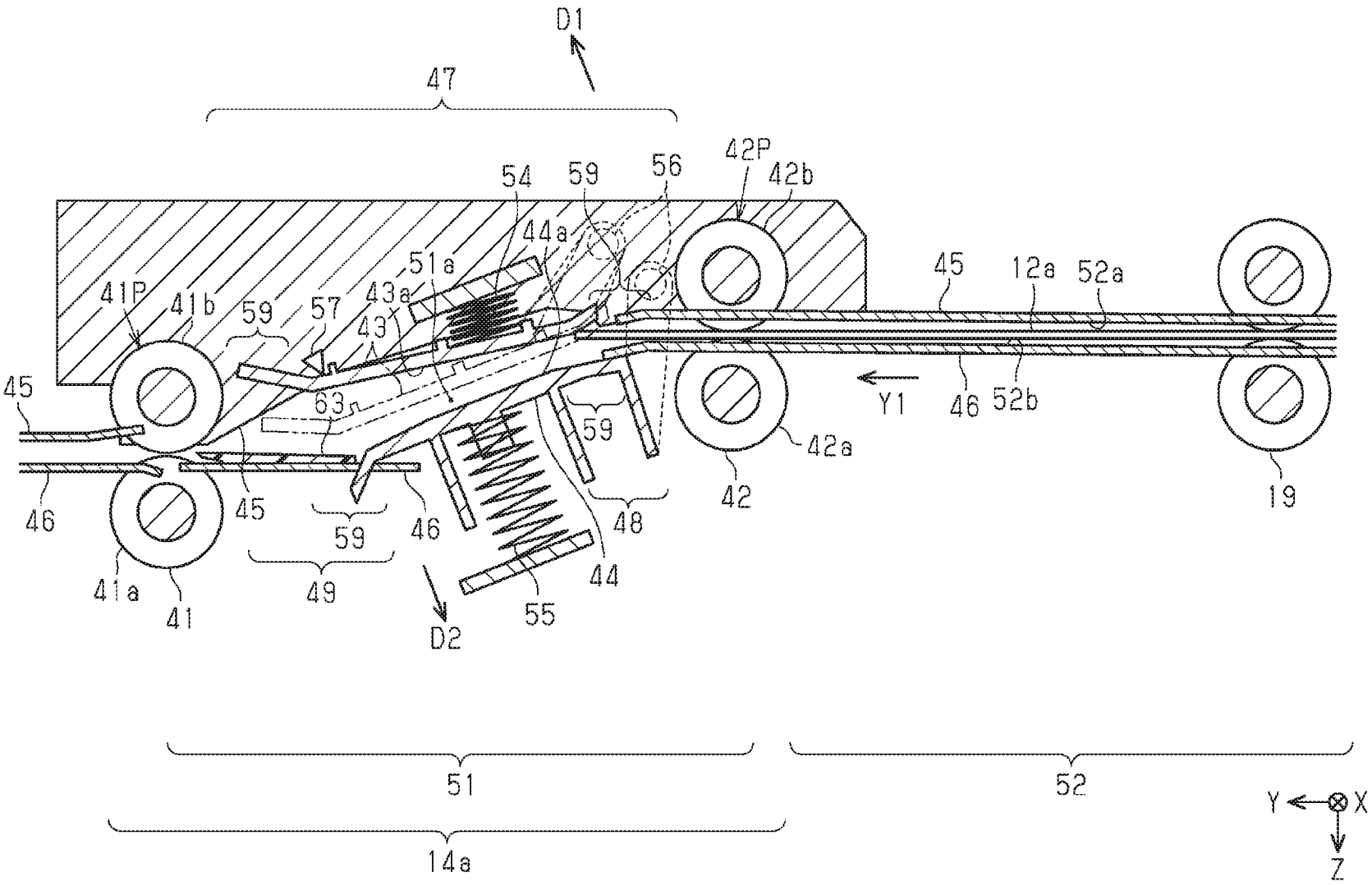
FIG. 3 is a schematic cross-sectional view illustrating a state when a front end of a first medium abuts a first guide portion and the first guide portion swings.

As illustrated in FIG. 3, in a case where the medium supplying portion 42 supplies a first medium 12*a* to the contact portion 41, when the first medium 12*a* contact with the first guide portion 43 before the front end of the first medium 12*a* reaches the contact portion 41, the first guide portion 43 is urged with a load that causes a swing in a direction away from the second guide portion 44. Moreover, in a case where the second medium 12*b* having a smaller basis weight than the first medium 12*a* is supplied to the contact portion 41, when the second medium 12*b* contact with the first guide portion 43 before the front end of the second medium 12*b* reaches the contact portion 41, the first guide portion 43 is urged with a load that does not cause a swing (see FIG. 8).

The load of the first guide portion 43 is set up as follows, for example. When the first medium 12*a* such as thick paper that has strong rigidity and is hard to bend is transported, until the front end of the first medium 12*a* reaches the nip portion of the pair of transporting rollers 41P of the contact portion 41, the maximum load among the loads by which the first medium 12*a* pushes up the first guide portion 43 is defined as the maximum load. Further, when the second medium 12*b* such as thin paper that has weak rigidity and is easy to bend is transported, until the front end of the second medium 12*b* reaches the nip portion of the pair of transporting rollers 41P of the contact portion 41, the minimum load that cannot push up the first guide portion 43 is defined as the minimum load. The swing load of the first guide portion 43 is set between the minimum load and the maximum load. The pushing force of the first urging member 54 is set so that this swing load is obtained.

Further, the load of the second guide portion 44 is set as follows, for example. When the second medium 12*b* is further pushed in after the front end of the second medium 12*b* such as thin paper having the lowest rigidity among the media 12 that can be transported in the post-processing device 14, reaches the nip portion of the pair of transporting rollers 41P that constitutes the contact portion 41, the load is set such that the second guide portion 44 is stably pushed down by the second medium 12*b*.

The first medium 12*a* is a medium having a large basis weight that does not cause curl, and the second medium 12*b* is a medium having a small basis weight that causes curl with a small radius of curvature. For example, the basis weight of the first medium 12*a* is 100 gsm to 300 gsm, and the basis weight of the second medium 12*b* is 60 gsm to 100 gsm. Some commercially available papers have a basis weight of 55 gsm or 450 gsm, and the basis weight is not limited to this value.

Figure 10:
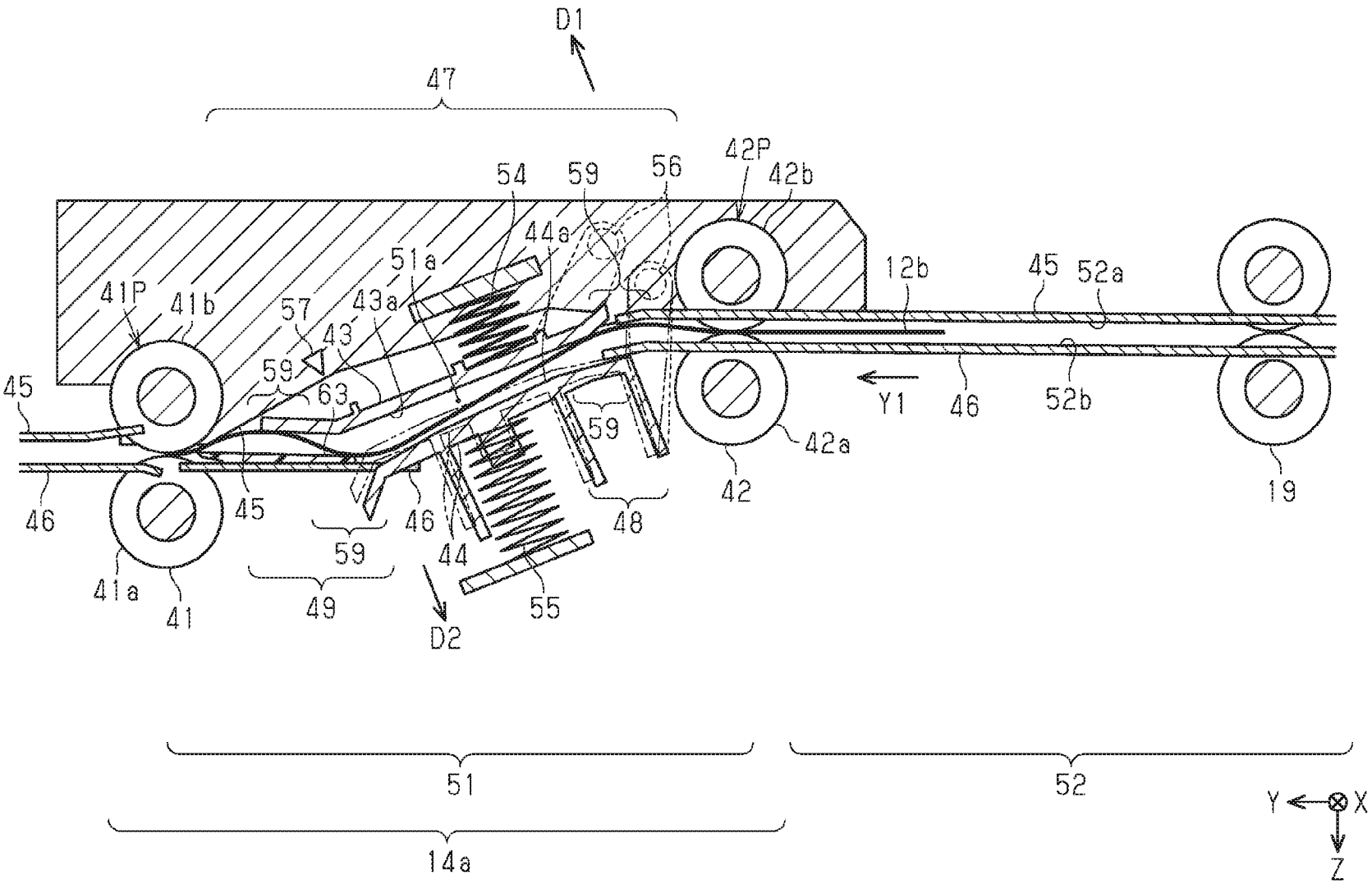
FIG. 10 is a schematic cross-sectional view illustrating a state in which the medium supplying portion further supplies the second medium from the state illustrated in FIG. 9.

As illustrated in FIG. 10, in order to correct the skew even for the medium 12 having a small basis weight, it is necessary to secure a space between the contact portion 41 and the medium supplying portion 42 so that the medium 12 forms a curved part for correcting the skew. Therefore, when the second medium 12*b* contact with the second guide portion 44 after the front end of the second medium 12*b* reaches the contact portion 41, the second guide portion 44 is urged with a load that causes a swing in a direction away from the first guide portion 43.

The pair of transporting rollers 41P of the contact portion 41 is driven by a contact portion driving motor 53. The contact portion driving motor 53 is a motor different from the transporting motor 18 that drives the pair of transporting rollers 42P of the medium supplying portion 42, and the pair of transporting rollers 41P of the contact portion 41 can be independently driven and stopped in rotation.

The pair of transporting rollers 41P of the contact portion 41 stops rotating until the front end of the medium 12 contacts the contact portion 41. Since the sensor 57 that is on the upstream of the contact portion 41 detects the front end of the medium 12, the control portion 30 ascertains the front end position of the medium 12 from the rotation amount of the transporting motor 18. After the sensor 57 detects the front end of the medium 12 and when a predetermined time has elapsed after the front end of the medium 12 abuts on the contact portion 41, the control portion 30 drives the contact portion driving motor 53 to rotate the pair of transporting rollers 41P of the contact portion 41. Therefore, the control portion 30 adjusts the curved amount of the medium 12 required for the medium 12 to correct the skew in the guide portion 47 between the contact portion 41 and the medium supplying portion 42.

As illustrated in FIG. 1, the processing device 14*b* includes the punching processing portion 50 as an example of a processing portion that performs a process with respect to the medium 12 that has passed through the contact portion 41. The punching processing portion 50 is provided on the transporting path 17 more downstream than the contact portion 41 in the transporting direction Y1. The punching processing portion 50 includes a punching mechanism 60 that performs a punching process on the medium 12.

The punching processing portion 50 is constituted by a punching mechanism 60 that performs a punching process for punching a punching hole in the medium 12, a pair of transporting rollers 19 that exhausts the medium from the punching processing portion 50, and a transporting path 17 from the contact portion 41 to the pair of transporting rollers 19. Further, since the sensor 57 constituting the curved transporting path 51 also detects the rear end of the medium 12 for the punching processing portion 50 to perform the punching process, it can be said that the sensor 57 is a part of the punching processing portion 50.

The operation of the present embodiment will be described.

First, the operation on the first medium 12*a* will be described.

As illustrated in FIG. 2, when the first medium 12*a* having a large basis weight is carried into the post-processing device 14 by the printing device 13, the first medium 12*a* is transported in the transporting direction Y1 by the pair of transporting rollers 19 near the carry-in port 58 (see FIG. 1). The control portion 30 (see FIG. 1) of the post-processing device 14 ascertains that the first medium 12*a* has been carried in and the transporting position of the first medium 12*a*.

As illustrated in FIG. 3, the first medium 12*a* is transported in the transporting direction Y1 by the pair of transporting rollers 19, and further transported by the pair of transporting rollers 42P of the medium supplying portion 42 that is on the downstream of the pair of transporting rollers 19. The first medium 12*a* has very little curl after the recording. For example, since the first medium 12*a* has a large thickness and a large volume, and since the water content ratio indicating the ratio of the water content per volume of the first medium 12*a* is small at a water content recorded by the printing device 13 which is an ink jet printer, curl rarely occurs. Therefore, the front end of the first medium 12*a* abuts the end portion near the swing center 56 of the guide surface 43*a* of the first guide portion 43 that is provided on the first direction D1 side of the first curved path 48.

Since the first urging member 54 of the first guide portion 43 has a large pushing force and the position where the front end of the medium 12 abuts is near the swing center 56, in order to swing the first guide portion 43, the front end of the first medium 12*a* needs to strongly push the guide surface 43*a*. However, since the first medium 12*a* having a large basis weight has a large thickness and high rigidity, the first guide portion 43 swings in a direction away from the second guide portion by being pushed from the front end of the first medium 12*a*. Therefore, the first medium 12*a* is transported toward the contact portion 41 on the downstream through the guide portion 47 while increasing the distance between the first transporting surface 45 and the second transporting surface 46.

Figure 4:
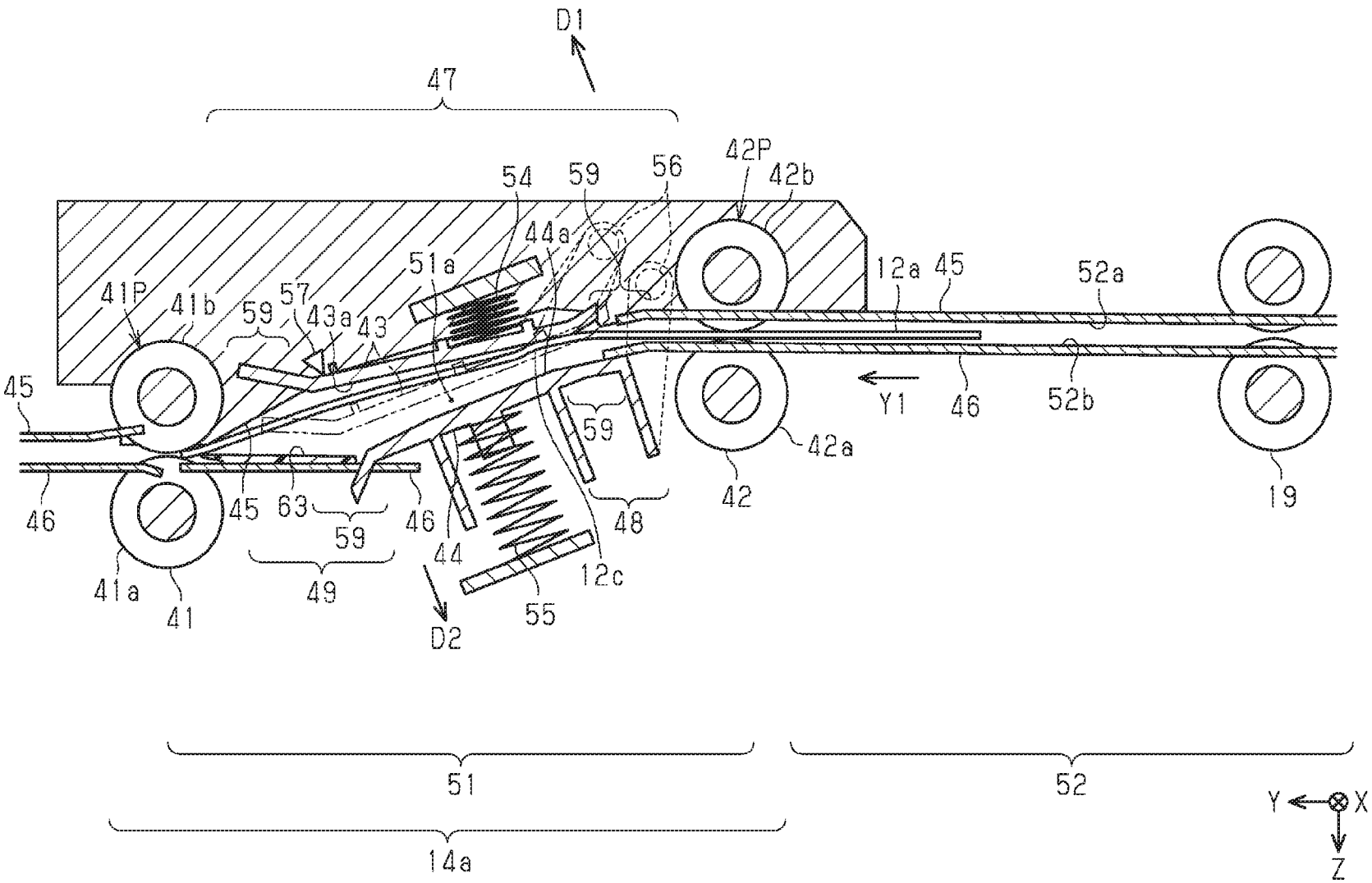
FIG. 4 is a schematic cross-sectional view illustrating a state when the front end of the first medium contacts with a contact portion.

As illustrated in FIG. 4, as the first guide portion 43 swings in the direction away from the second guide portion, the first transporting surface 45 moves upward, so that the first medium 12*a* is transported on a path that is close to the shortest path from the medium supplying portion 42 to the contact portion 41 in a state close to a straight plane. That is, the first medium 12*a* pushes the first guide portion 43 in the first direction D1 away from the second guide portion 44 by its own rigidity, and is transported until the front end thereof reaches the contact portion 41 along the first transporting surface 45 with a path that is close to the shortest path.

At this time, the pair of transporting rollers 41P of the contact portion 41 still stops rotating. When the front end of the first medium 12*a* reaches the contact portion 41, the first guide portion 43 remains in a swinging state. Since the distance between the first transporting surface 45 and the second transporting surface 46 remains large, the space for the first medium 12*a* to curve widens toward the second direction D2 side between the contact portion 41 and the medium supplying portion 42. The first medium 12*a* is not substantially curved. The first medium 12*a* is positioned along the first transporting surface 45, which is the upper surface of the guide portion 47, and is close to a straight plane, but is in a state having a slight projection shape in the upper direction.

When the first medium 12*a* is skewed, either the front end corner portion on the −X side in the width direction or the front end corner portion on the +X side in the width direction of the first medium 12*a*, contacts with the nip portion of the pair of transporting rollers 41P firstly. When either one of the front end corner portions of the first medium 12*a* contacts with the nip portion of the pair of transporting rollers 41P firstly, in the first medium 12*a*, a small bending portion 12*c*, which triggers bending on the lower side, is formed at a part corresponding to a place where the first medium 12*a* starts to abut the first guide portion 43. The front end of the first medium 12*a* starts to bend to the lower side.

For example, in a case where the front end corner portion on the −X side in the width direction contacts with the nip portion of the pair of transporting rollers 41P firstly, when the medium supplying portion 42 continues to transport the first medium 12*a*, the part of the first medium 12*a* on the −X side in the width direction is curved toward a second transporting surface 46 which is the second direction D2 side of the guide portion 47. Thereafter, the front end corner portion of the first medium 12*a* on the +X side in the width direction contacts the nip portion of the pair of transporting rollers 41P, and also the part of the first medium 12*a* on the +X side in the width direction is curved along the second transporting surface 46 which is the second direction D2 side of the guide portion 47. Therefore, the curved amount of the curved part of the first medium 12*a* is large on the −X side in the width direction and small on the +X side in the width direction. That is, when the alignment of the front end of the first medium 12*a* coincides with the alignment of the nip portion of the pair of transporting rollers 41P, the first medium 12*a* is curved in a curved shape asymmetrically distorted in the width direction X.

Figure 5:
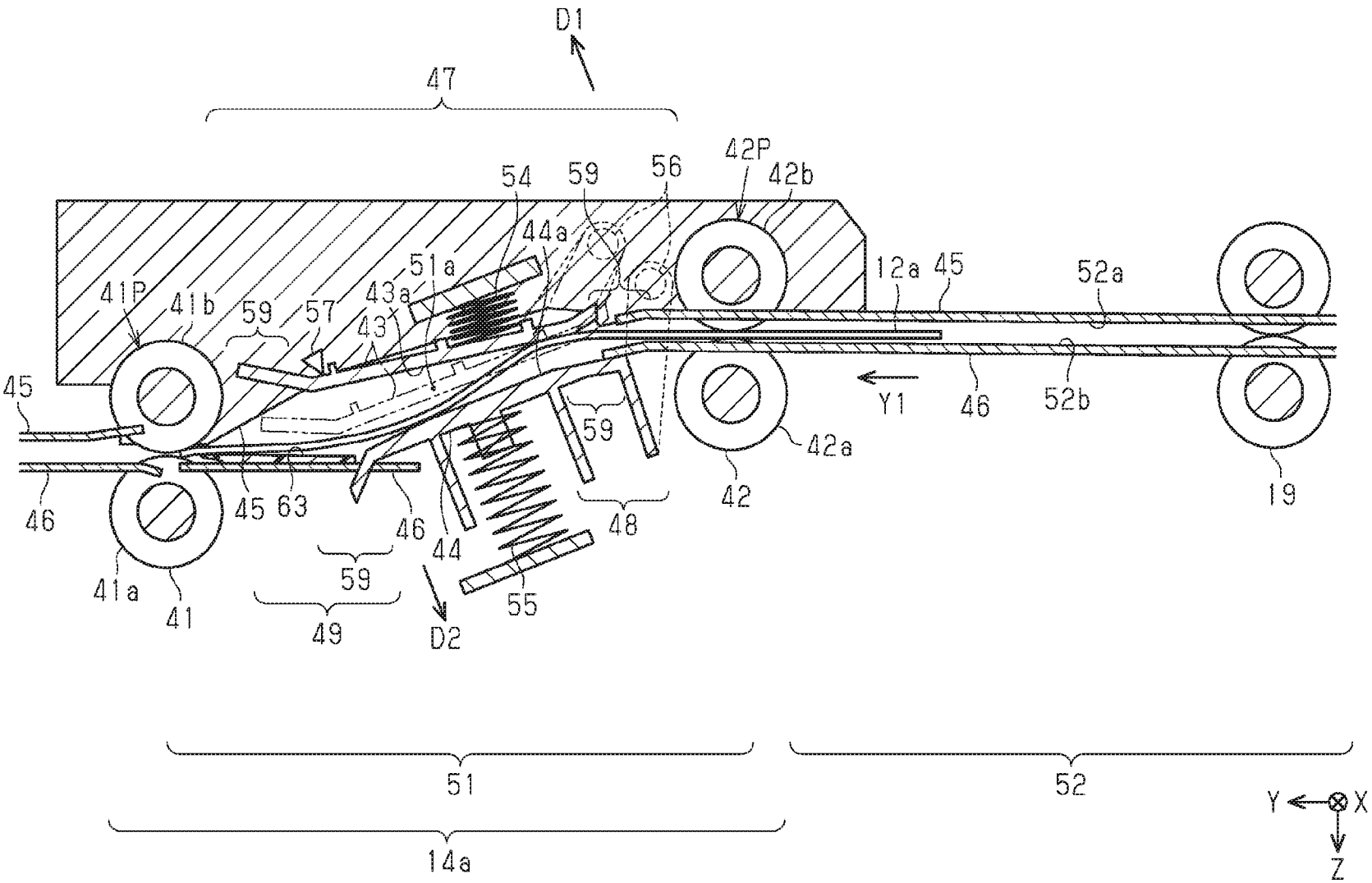
FIG. 5 is a schematic cross-sectional view illustrating a state in which a medium supplying portion further supplies the first medium from the state illustrated in FIG. 4.

As illustrated in FIG. 5, the first medium 12*a* starts to bend in a direction in which a projection shape is formed on the lower side. The pushing force of the first medium 12*a* against the first guide portion 43 is determined by the urging force of the first urging member 54 and the position of the swing center 56 of the first guide portion 43. Whether the first guide portion 43 moves in the direction of returning to the standby position, is determined by the urging force of the first guide portion 43 and the pushing force of the first medium 12*a* against the first guide portion 43. When the urging force of the first guide portion 43 is stronger than the pushing force of the first medium 12*a*, as the first medium 12*a* bends to the lower side, the first guide portion 43 moves in the direction of returning to the standby position (the position indicated by the two-dot chain line). When the urging force of the first guide portion 43 is weaker than the pushing force of the first medium 12*a*, as the first medium 12*a* bends to the lower side, the first guide portion 43 does not move in the direction of returning to the standby position (see FIG. 5).

Since the first medium 12*a* has higher rigidity than the second medium 12*b*, when the front surface of the first medium 12*a* is completely along the second transporting surface 46 and the contact area increases, the sliding resistance increases and the first medium 12*a* becomes difficult to move. However, after the formation of the curved part is started along the second transporting surface 46 which is the second direction D2 side of the guide portion 47 of the first medium 12*a* on the −X side in the width direction, and before the first medium 12*a* on the −X side in the width direction is completely along the second transporting surface 46, the front end corner portion of the first medium 12*a* on the +X side in the width direction contacts with the nip portion of the pair of transporting rollers 41P. Therefore, the first medium 12*a* receives no pushing force from the second transporting surface 46 or only a very small pushing force. The first medium 12*a* is transported on a path close to the shortest path along the first transporting surface 45 until the front end thereof reaches the contact portion 41, the first medium 12*a* starts to bend in the direction, in which a projection shape is formed on the lower side, by utilizing the space formed on the lower side in the transporting procedure. Therefore, the curved part in which a projection shape is formed on the lower side receives no pushing force from the second transporting surface 46, or only a very small pushing force. Therefore, when the curved part of the first medium 12*a* is restored, the front end of the first medium 12*a* easily abuts the nip portion of pair of transporting rollers 41P.

Figure 6:
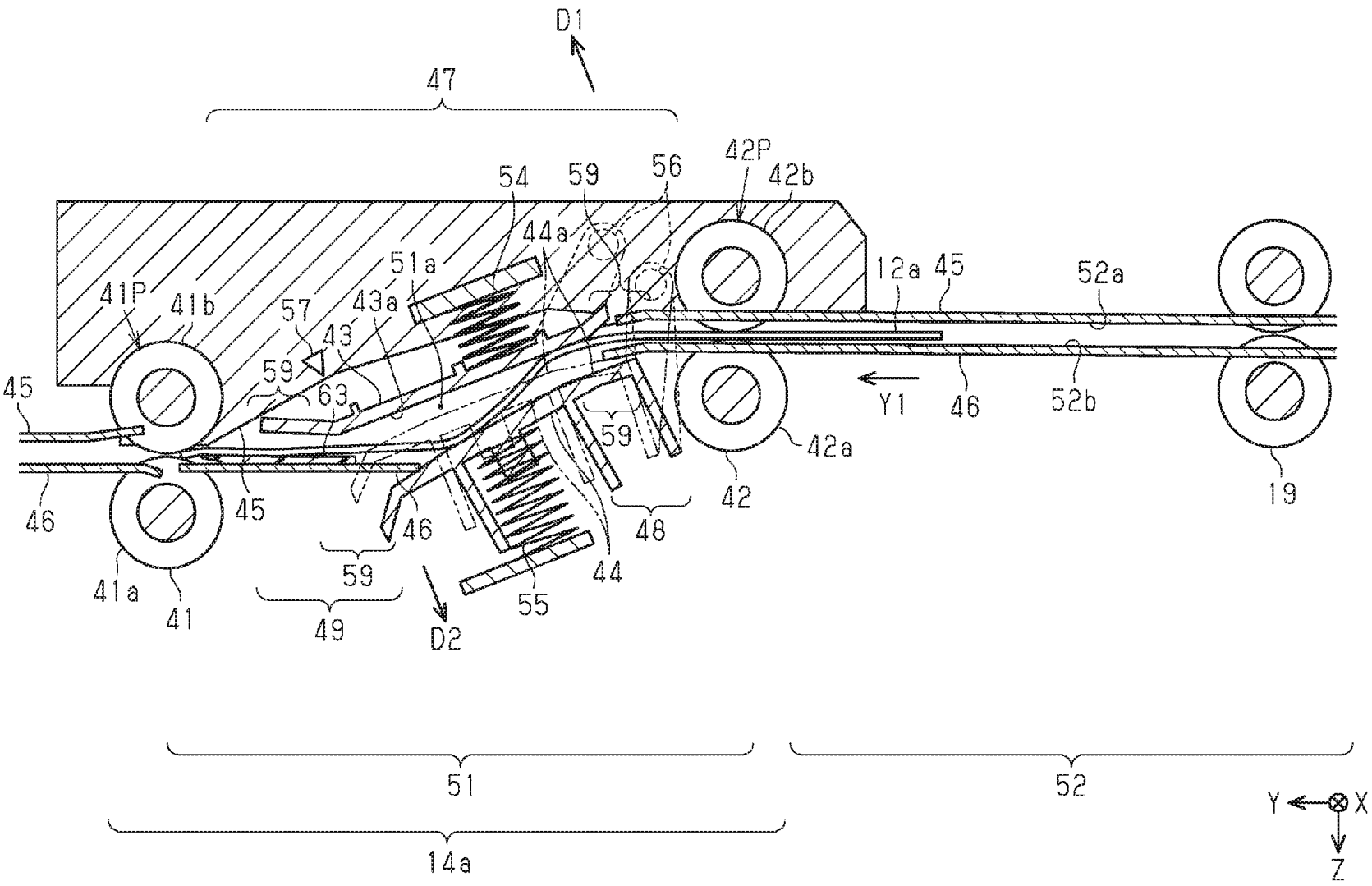
FIG. 6 is a schematic cross-sectional view illustrating a state in which the medium supplying portion further supplies the first medium from the state illustrated in FIG. 5.

At this point, when the front end of the first medium 12*a* abuts the nip portion of the pair of transporting rollers 41P and the maximum possible skew can be corrected, the amount by which the medium supplying portion 42 feeds the first medium 12*a* toward the contact portion 41 is set to a value capable of forming the curved portion illustrated in FIGS. 5 and 6. After a lapse of time for the first medium 12*a* to be curved into an appropriate shape necessary for correcting the skew, the control portion 30 rotates the pair of transporting rollers 41P of the contact portion 41. The first medium 12*a* is transported downstream by the pair of transporting rollers 41P of the contact portion 41 in an alignment state in which the side of the front end of the first medium 12*a* is parallel to the tangent line of the nip portion of the contact portion 41.

The first medium 12*a* is curved only on the second direction D2 side from a state close to the plane as illustrated in FIG. 4, toward the second transporting surface 46 as illustrated in FIGS. 5 and 6, and the curved part has a simple projection shape in the lower direction. The first medium 12*a* has a shape similar to an S shape second-order buckling mode, the load of forming the curved part is reduced, and the force required for the medium supplying portion 42 to supply the first medium 12*a* and the nip force required for the medium supplying portion 42 to hold the first medium 12*a* are small.

As illustrated in FIG. 6, the first medium 12*a* is curved in the second direction D2 and pushes down the second guide portion 44. Therefore, the distance from the second transporting surface 46 to the standby position of the first transporting surface 45 becomes long, and in the second curved path 49, a further space for the first medium 12*a* to curve is in a state secured on the first direction D1 side, which is an upper direction on the side closer to the front end of the first medium 12*a*.

When the skew cannot be sufficiently corrected by the curved amount of the first medium 12*a* illustrated in FIGS. 5 and 6, the medium supplying portion 42 can set a large amount of feeding the first medium 12*a* after the front end of the first medium 12*a* contacts the contact portion 41. That is, by increasing the time from when the sensor 57 detects the front end of the medium 12 to when the contact portion driving motor 53 (see FIG. 1) is driven to rotate the pair of transporting rollers 41P of the contact portion 41, the control portion 30 (see FIG. 1) lengthens the curved amount of the medium 12 required for the medium 12 to correct the skew in the guide portion 47 between the contact portion 41 and the medium supplying portion 42.

Figure 7:
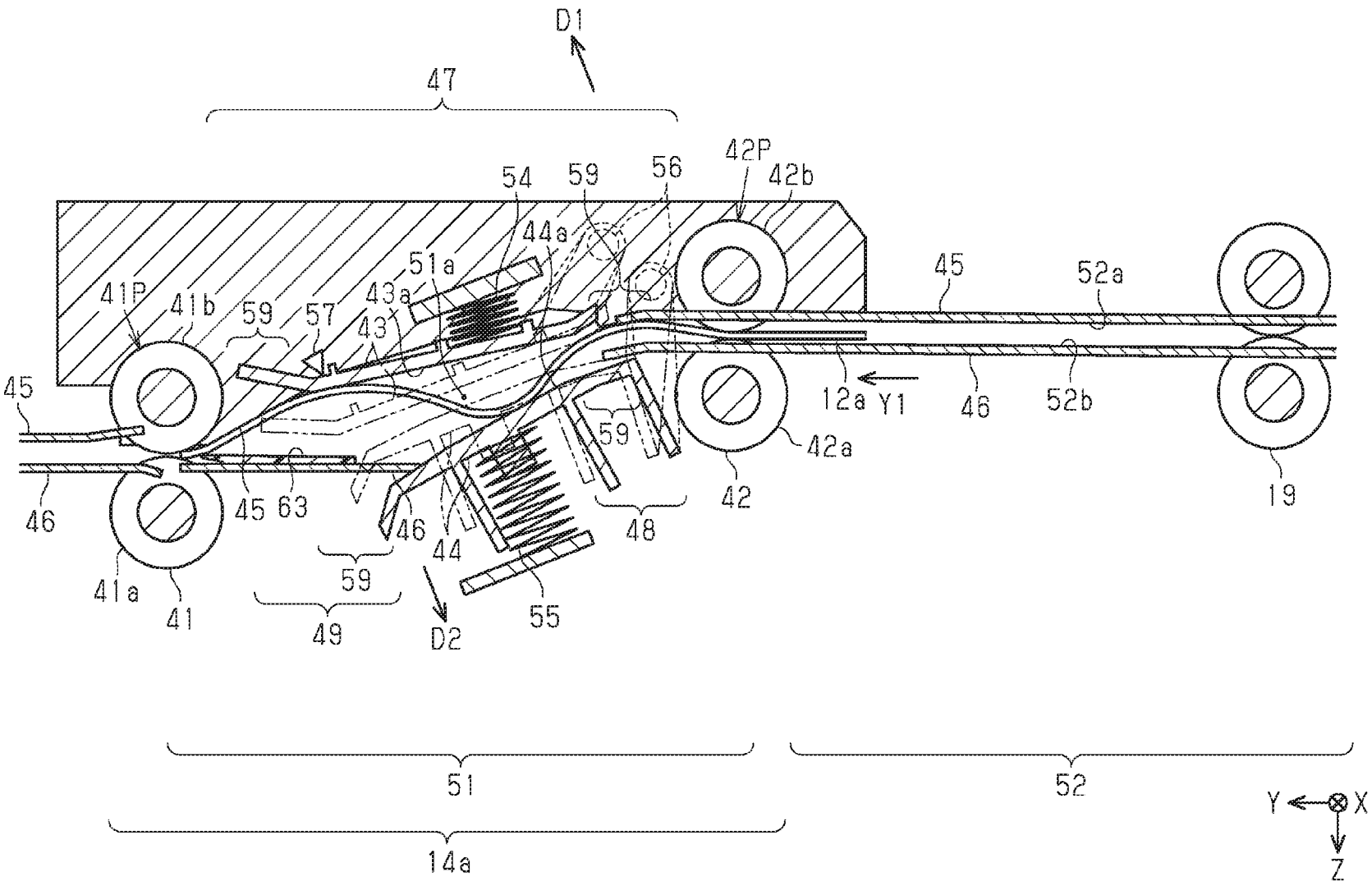
FIG. 7 is a schematic cross-sectional view illustrating a state in which the medium supplying portion further supplies the first medium from the state illustrated in FIG. 6.

As illustrated in FIG. 7, the front end part of the first medium 12*a* forms a curved part having a projection shape in the upper direction. Therefore, the first medium 12*a* is curved in an inverted W shape including a curved part having a projection shape in the lower direction and a curved part having a projection shape in the upper direction. The front end of the first medium 12*a* is pushed against the nip portion of the pair of transporting rollers 41P due to the restoring force of the curved part of the first medium 12*a* to return to the original state, and thus the skew of the first medium 12*a* is corrected. Therefore, even when the skew of the first medium 12*a* is very large, the skew of the first medium 12*a* is corrected. However, since the curved part has a shape close to a W shape third-order buckling mode and two curved parts are formed within a short distance, the load of forming the curved part increases. Therefore, the transporting force required by the pair of transporting rollers 42P that supplies the first medium 12*a* and the holding force required for the pair of transporting rollers 41P contacting the front end of the first medium 12*a* to stop the front end of the paper increase. The pairs of transporting rollers 41P and 42P set the nip forces of the pairs of transporting rollers 41P and 42P to large values, and are configured such that no slip occurs between the front and back surfaces of the first medium 12*a* and the transporting rollers 41*a*, 41*b*, 42*a*, 42*b*.

After a lapse of required time for the first medium 12*a* to be curved into an appropriate shape for correcting the skew, the control portion 30 rotates the pair of transporting rollers 41P of the contact portion 41. The first medium 12*a* is transported downstream by the pair of transporting rollers 41P of the contact portion 41 in an alignment state in which the side of the front end of the first medium 12*a* is parallel to the tangent line of the nip portion of the contact portion 41.

As illustrated in FIG. 1, the sensor 57 detects that the rear end of the first medium 12*a* has passed the sensor 57. The front end of the first medium 12*a* passes through the punching mechanism 60, and then passes through the pair of transporting rollers 19 positioned downstream of the punching mechanism 60. When the rear end of the first medium 12*a* passes through the contact portion 41, the rear end of the first medium 12*a* is transported downstream in a state where the alignment of the rear end of the first medium 12*a* also coincides with the alignment of the nip portion of the pair of transporting rollers 41P. Thereafter, the pair of transporting rollers 41P stops rotating in preparation for the skew correction process for the next medium 12.

The control portion 30 of the post-processing device 14 ascertains the rear end position of the medium 12 from the amount of rotation of the transporting motor 18 after the sensor 57 detects the rear end of the first medium 12*a*. The control portion 30 stops the transporting motor 18 and operates the punching mechanism 60 when the desired position of the first medium 12*a* is directly below the punching mechanism 60. The punching mechanism 60 can punch a punching hole in the rear end portion of the first medium 12*a* after the skew is corrected. The punch dust generated by punching a punching hole in the medium 12 by the punching mechanism 60 is accommodated in the punch dust box 62 below the transporting path 17.

Next, the action on the second medium 12*b* will be described.

Figure 8:
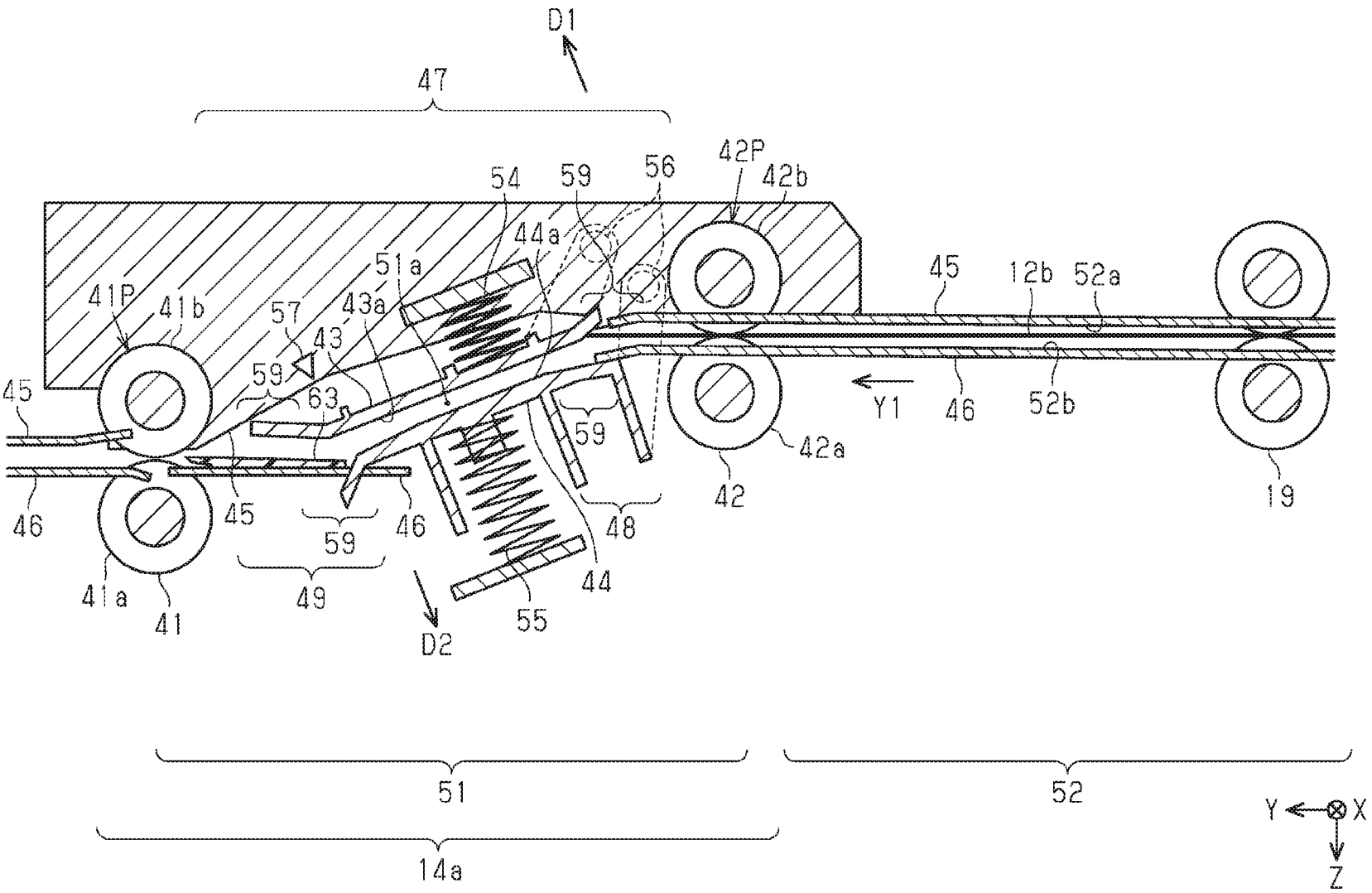
FIG. 8 is a schematic cross-sectional view illustrating a state when a front end of a second medium contacts with the first guide portion.

As illustrated in FIG. 8, the second medium 12*b* is transported in the transporting direction Y1 by the pair of transporting rollers 19, and further transported by the pair of transporting rollers 42P of the medium supplying portion 42 that is on the downstream of the pair of transporting rollers 19. Similar to the case of the first medium 12*a*, the front end of the second medium 12*b* abuts the end portion near the swing center 56 of the guide surface 43*a* of the first guide portion 43 that is provided on the first direction D1 side of the first curved path 48.

Since the first urging member 54 of the first guide portion 43 has a large pushing force and further, the position where the front end of the second medium 12*b* abuts is the first transporting surface 45 near the swing center 56, in order to swing the first guide portion 43, a large force is required. Since the second medium 12*b* having a small basis weight has a small thickness and is easily bent, the force for bending the second medium 12*b* in which the front end abuts the guide surface 43*a* is smaller than the force for contracting the first urging member 54. Therefore, the second medium 12*b* gently bends along the guide surface 43*a* of the first guide portion 43 at the standby position without swinging, and is transported through the guide portion 47 toward the downstream contact portion 41.

Figure 9:
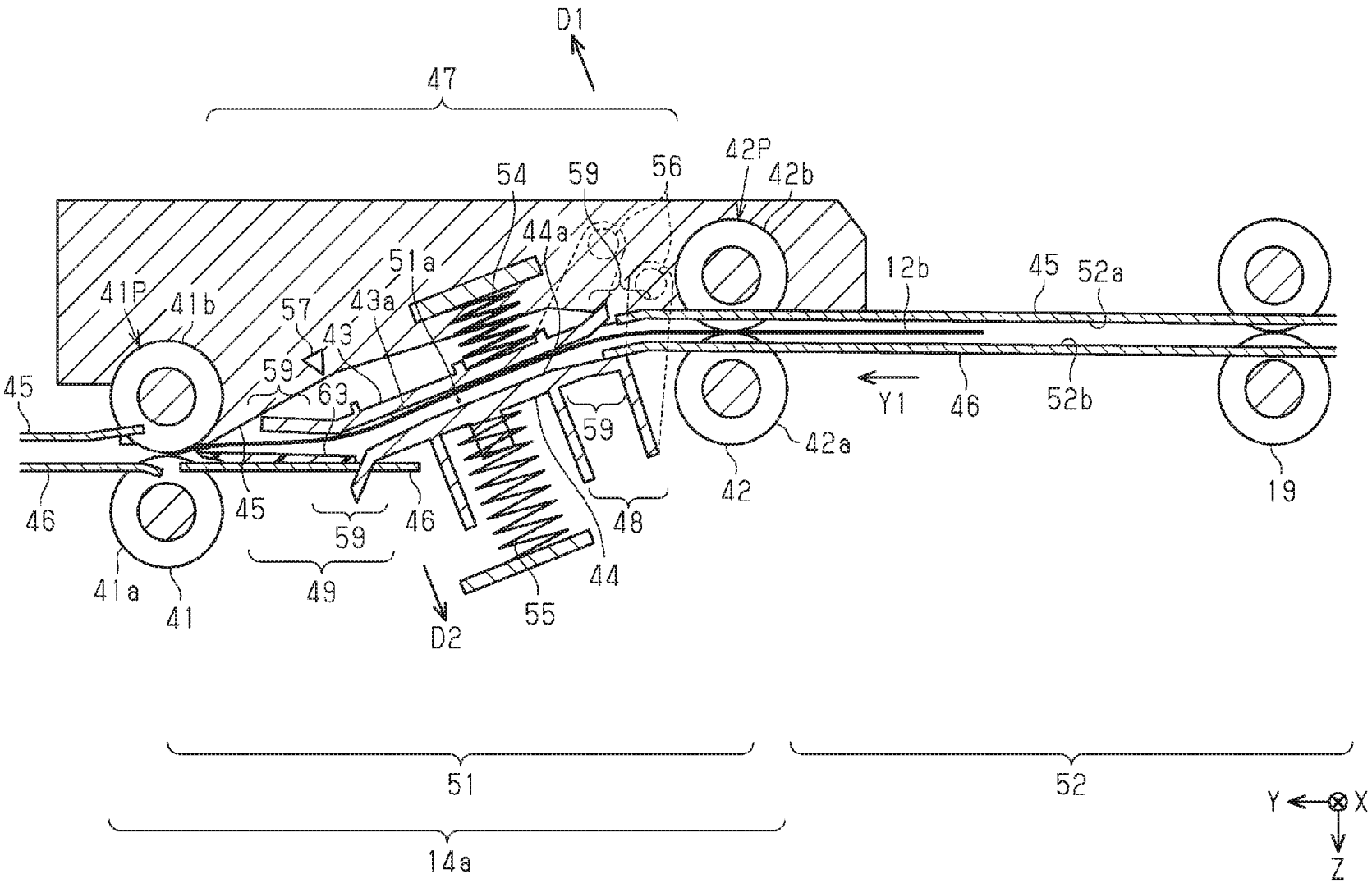
FIG. 9 is a schematic cross-sectional view illustrating a state when the front end of the second medium contacts with the contact portion.

As illustrated in FIG. 9, the pair of transporting rollers 41P of the contact portion 41 still stops rotating. Since the distance between the first transporting surface 45 and the second transporting surface 46 is short, the curl in the front end portion of the second medium 12*b* is suppressed, and even when the force that causes upward curl or downward curl is working, the front end of the second medium 12*b* reaches the contact portion 41 without being caught by the guide portion 47 or the seam 59. The second medium 12*b* is positioned along the first transporting surface 45, which is the upper surface of the guide portion 47, from the vicinity of the downstream of the medium supplying portion 42 to the upstream part of the guide surface 43*a* of the first guide portion 43. In the vicinity of the upstream of the contact portion 41, the second medium 12*b* is positioned along the second transporting surface 46 which is the lower surface of the guide portion 47. That is, the second medium 12*b* is in an S shape state in the side view illustrated in FIG. 9. As described above, in the part of the curved transporting path 51, the nip position of the pair of transporting rollers 42P at which the upstream end of the second medium 12*b* is nipped and the nip position of the pair of transporting rollers 41P with which the downstream end thereof contacts, have a positional relationship in which the height positions are different from each other in the vertical direction Z, and the gap between the pair of guide portions 43 and 44 facing each other in an inclined posture between both nip positions is used as the transporting path for the second medium 12*b*. The second medium 12*b* is transported along the S shape transporting path until the front end thereof reaches the contact portion 41.

As illustrated in FIG. 10, even after one side of the front end corner portion of the skewed second medium 12*b* reaches the contact portion 41, the medium supplying portion 42 further continues to transport the second medium 12*b*, and thus in the second medium 12*b*, the front surface of the second medium 12*b* on the side where the front end corner portion reaches the contact portion 41 is bent and curved between the contact portion 41 and the medium supplying portion 42. The second medium 12*b* cannot push up the first guide portion 43 having a large pushing force, but can push down the second guide portion 44 having a small pushing force.

Since the swing center 56 of the second guide portion 44 is provided on the side where the first guide portion 43 is positioned with respect to the transporting path 17, when the second medium 12*b* abuts the second guide portion 44, the vector component in the direction in which the second guide portion 44 swings can be increased. Further, the swing center 56 of the second guide portion 44 is positioned closer to the upstream end than the downstream end of the second guide portion 44. Therefore, the curved portion formed by the second medium 12*b* bending downward pushes the downstream end part, which is away from the swing center 56 of the second guide portion 44, with respect to the second guide portion 44. Therefore, the second guide portion 44 is likely to swing even with a slight force, and the second medium 12*b* is curved without buckling. The second guide portion 44 is pushed down by the curved part of the second medium 12*b*.

When the front surface of the second guide portion 44 and the front surface of the first medium 12*a* close contact with each other, the sliding resistance becomes large and the first medium 12*a* becomes difficult to move. However, since the second medium 12*b* has a lower rigidity than the first medium 12*a*, the sliding resistance between the front surface of the second medium 12*b* and the front surface of the second guide portion 44 is low and the second medium 12*b* is easily deformed.

Due to the restoring force of the curved part of the second medium 12*b* to return to the original state, the front end corner portion on the reverse side to the side that first contacts the nip portion of the pair of transporting rollers 41P is pushed against the nip portion of the pair of transporting rollers 41P. Therefore, the alignment of the front end of the second medium 12*b* is corrected along the nip portion of the pair of transporting rollers 41P. The alignment shifting between the front end and the rear end of the second medium 12*b* is absorbed by the curved part by asymmetrically distorting the shape of the curved part in the width direction X, and thus the skew of the second medium 12*b* is corrected.

As illustrated in FIG. 10, after a lapse of time for the second medium 12*b* to be curved into an appropriate shape necessary for correcting the skew, the control portion 30 rotates the pair of transporting rollers 41P of the contact portion 41. The second medium 12*b* is transported downstream by the pair of transporting rollers 41P of the contact portion 41 in an alignment state in which the side of the front end of the second medium 12*b* is parallel to the tangent line of the nip portion of the contact portion 41.

The sensor 57 (see FIG. 1) detects that the rear end of the second medium 12*b* has passed the sensor 57. The front end of the second medium 12*b* passes through the punching mechanism 60, and then passes through the pair of transporting rollers 19 positioned downstream of the punching mechanism 60. When the rear end of the second medium 12*b* passes through the contact portion 41, the alignment of the rear end of the second medium 12*b* is transported downstream in a state where the alignment of the rear end of the second medium 12*b* also coincides with the alignment of the pair of transporting rollers 41P of the contact portion 41. Thereafter, the pair of transporting rollers 41P stops rotating in preparation for the skew correction process for the next medium 12.

The post-processing device 14 can ascertain the rear end position of the medium 12 from the amount of rotation of the transporting motor 18 after the sensor 57 detects the rear end of the second medium 12*b*. The post-processing device 14 stops the transporting motor 18 and operates the punching mechanism 60 when the desired position of the first medium 12*a* is directly below the punching mechanism 60. The punching mechanism 60 can punch a punching hole in the rear end of the first medium 12*a* with correct alignment. The punch dust generated by punching a punching hole in the medium by the punching mechanism 60 is accommodated in the punch dust box 62 below the transporting path 17. Since the transporting path 17 is positioned below the post-processing device 14, the paper dust generated by the punching process does not drop into the transporting path 17 and the paper dust is prevented from attaching to the medium 12 transported through the transporting path 17.

The effects of the present embodiment will be described.

1. The first guide portion 43 and the second guide portion 44 are disposed at a standby position when the medium 12 is not transported through the transporting path 17, and are provided so as to be movable in a direction away from each other from the standby position. When the skew is corrected, the front end of the medium 12 contacts with the nip portion of the pair of transporting rollers 41P of the contact portion 41, the curved part is formed on the medium 12, and the transporting state of the medium 12 is adjusted by swinging one or both of the first guide portion 43 and the second guide portion 44 in accordance with the tendency of the ease of bending after recording depending on the type of medium 12. That is, the present device can change the swinging state of one or both of the first guide portion 43 and the second guide portion 44 in accordance with the tendency of bending after recording depending on the type of medium, and can correct the skew of a plurality of types of media.

2. The transporting path 17 includes the curved transporting path 51 having the first curved path 48 and the second curved path 49 from the medium supplying portion 42 to the contact portion 41. Before the front end of the medium 12 transported through the curved transporting path 51 supplied from the medium supplying portion 42 reaches the pair of transporting rollers 41P, the front end of the medium 12 pushes the first guide portion 43. Moreover, after the front end of the medium 12 contacts with the pair of transporting rollers 41P, the medium 12 can push the second guide portion 44 or the first guide portion 43 to be curved. The force with which the medium 12 pushes the first guide portion 43 and the second guide portion 44 differs in accordance with the tendency of the ease of bending depending on the type of medium after recording. The first medium 12*a* widens the transporting path 17 with the front end thereof by strongly pushing the first guide portion 43 to swing from the standby position. By widening the transporting path 17, the space for the curve is greatly widened toward the second direction D2. One side of the front end of the skewed first medium 12*a* contacts the pair of transporting rollers 41P, and in the second curved path 49 on the downstream of the first curved path 48 in the transporting direction Y1, the front end part of the first medium 12*a* forms a curved part having a projection shape on the second direction D2 side. At this time, by reducing the pressure when the curved part of the first medium 12*a* and the second guide portion 44 contact with each other, the curved part of the first medium 12*a* can easily be largely curved in the state of being asymmetrically distorted in the width direction X. Therefore, after the front end of the first medium 12*a* contacts with the contact portion 41, the skew can be corrected by utilizing the restoring force of the large curved part. There is also a curved mode in which the curved part of the first medium 12*a* and the second guide portion 44 do not contact with each other when the front end part of the first medium 12*a* forms a curved part having a projection shape on the second direction D2 side, and in this case, the first medium 12*a* can also be largely curved by the swing of the first guide portion 43.

On the other hand, the second medium 12*b* has a weak force for pushing the first guide portion 43, and thus the second medium 12*b* cannot swing the first guide portion 43 from the standby position, or can swing the first guide portion 43 with a smaller swing amount as compared with the first medium 12*a*. As a result, in the procedure in which the front end of the second medium 12*b* reaches the pair of transporting rollers 41P, the transporting path 17 does not widen, or even when the transporting path 17 widens, the widening amount thereof is smaller than when the medium of the first medium 12*a* is transported. Therefore, the second medium 12*b* is transported in the narrow transporting path 17, and for example, the curling of the front end portion is suppressed, and thus jamming is suppressed.

Therefore, it is possible to appropriately correct the skew of a plurality of types of media while suppressing jamming of the second medium 12*b*.

3. An average value of a distance between the first transporting surface 45 and the second transporting surface 46 when the first guide portion 43 and the second guide portion 44 of the curved transporting path 51 are both positioned at the standby position, is equal to or less than an average value of a distance between the first transporting surface 45 and the second transporting surface 46 of the upstream transporting path 52. Curling of the second medium 12*b* during the transportation until the front end of the second medium 12*b* reaches the contact portion 41 is suppressed. Therefore, the front end of the second medium 12*b* curled in the space where the distance between the first transporting surface 45 and the second transporting surface 46 is widened during the transportation is caught by the first transporting surface 45 or the second transporting surface 46, and the front end thereof is rounded, so that the jam of the second medium 12*b* caused by this can be suppressed.

4. The distance between the first transporting surface 45 and the second transporting surface 46 of the curved transporting path 51 when the first guide portion 43 and the second guide portion 44 are positioned at the standby position is within 5 mm. While the front end of the second medium 12*b* is being transported through the curved transporting path 51, the curl at the front end portion of the second medium 12*b* does not get caught even when the curl enters the longest place of the distance between the first transporting surface and the second transporting surface, and the second medium 12*b* can be transported without causing a jam.

5. The load that causes the first guide portion 43 at the standby position to swing away from the second guide portion 44 is set larger than the load that causes the second guide portion 44 at the standby position to swing away from the first guide portion 43. The front end of the medium 12 supplied by the medium supplying portion 42 always abuts first the first guide portion 43 having a large load that causes a swing. Before the front end of the first medium 12*a* reaches the nip portion of the pair of transporting rollers 41P of the contact portion 41, the first medium 12*a* abuts the first guide portion 43 and swings the first guide portion 43 from the standby position, whereby the distance between the first transporting surface 45 and the second transporting surface 46 can widen. On the other hand, before the front end of the second medium 12*b* reaches the nip portion of the pair of transporting rollers 41P, the second medium 12*b* cannot swing the first guide portion 43. Therefore, since the second medium 12*b* passes through the narrow transporting path 17, the curling of the second medium 12*b* during the transportation is suppressed. Therefore, it is possible to properly correct the skew of the medium 12 regardless of the type of the medium 12 while suppressing the jam of the second medium 12*b*.

Further, after the front end of the second medium 12*b* contacts with the contact portion 41, the second medium 12*b* bends, and the bent curved part causes the second guide portion 44 to swing from the standby position. Therefore, since the second medium 12*b* can be curved, the skew of the second medium 12*b* can be corrected.

6. The swing center 56 of the first guide portion 43 is provided at a position closer to the upstream end than the downstream end of the first guide portion 43 in the transporting direction, and the swing center 56 of the second guide portion 44 is provided at a position closer to the upstream end than the downstream end of the second guide portion 44 in the transporting direction. When the front end of the medium 12 abuts the first guide portion 43 at a part on the upstream of the vicinity of the center of the guide portion 47 guided to the contact portion 41, the first guide portion 43 is less likely to swing, and after the front end contacts the contact portion 41, when the curved part of the medium 12 abuts the guide portions 43 and 44 at a part on the downstream of the vicinity of the center of the guide portion 47, the guide portions 43 and 44 can be easily swung. Therefore, it is possible to appropriately correct the skew of the first medium 12*a* and the second medium 12*b* while suppressing the jam of the second medium 12*b*.

Since the curved part of the medium 12 pushes a part farther from the swing center 56, which is a part closer to the downstream end than the upstream end of the second guide portion 44 in the transporting direction Y1, the second medium 12*b* easily swings the second guide portion 44 due to the relationship of the rotational moment.

7. Since the swing center 56 of the second guide portion 44 is provided on the side on which the first guide portion 43 is positioned of both sides interposing the transporting path 17, the second guide portion 44 is likely to swing greatly with a little force. When the feeding amount of the first medium 12*a* is set to a large amount by the medium supplying portion 42, by forming a curved part having a projection shape in the lower direction, the first medium 12*a* largely pushes down the second guide portion 44 due to the relationship of the rotational moment (see FIG. 5). By widening the transporting path 17, a space for the first medium 12*a* to curve can be created in the upper direction. The first medium 12*a* can form a curved part having a projection shape in the upper direction, and secure a curved amount necessary for correcting the skew (see FIG. 6). Accordingly, even when the skew of the first medium 12*a* is large, it is possible to prevent insufficient correction of the skew due to the insufficient curved amount. Therefore, even when the skew of the first medium 12*a* is large, the large skew of the first medium 12*a* is reliably corrected by the curved transporting path 51 that saves space as compared with the transporting path in the related art for adjusting the transporting state of the medium.

Due to the relationship of the vector direction of the force with respect to the rotational direction, the second guide portion 44 is likely to swing even with a little force. Moreover, when the second medium 12*b* is curved by swinging the second guide portion 44, the pushing force of the curved part against the second guide portion 44 is low. Even when the contact area between the second medium 12*b* and the second guide portion 44 increases, the sliding resistance does not increase, and the second medium 12*b* does not become difficult to move as the first medium 12*a*. Therefore, the skew of the front end of the medium can be reliably corrected even in a type of the medium having a low rigidity.

Furthermore, since the second guide portion 44 is likely to swing even with a little force, there is little risk that the second medium 12*b* buckles when the second medium 12*b* pushes down the second guide portion 44 after the front end of the second medium 12*b* contacts the contact portion 41.

8. When the first medium 12*a* contact the first guide portion 43 before the front end of the first medium 12*a* reaches the contact portion 41, the first guide portion 43 is urged with a load that causes a swing in a direction away from the second guide portion 44. A large space is formed below the first medium 12*a* by the first medium 12*a* pressing the first guide portion 43 and widening the transporting path 17. Therefore, since the first medium 12*a* forms a curved part having a projection shape in the lower direction by utilizing the large space, the contact pressure when the curved part contacts the guide portion 47 can be reduced. Accordingly, it is possible to suppress the sliding resistance when the front surface of the first medium 12*a* slides with the guide portion 47 to be small, and it is possible for the first medium 12*a* to be curved in the width direction X with asymmetric distortion. Therefore, the skew of the first medium 12*a* can be corrected.

On the other hand, when the second medium 12*b* contact with the first guide portion 43 before the front end of the second medium 12*b* having a smaller basis weight than that of the first medium 12*a* reaches the contact portion 41, the first guide portion 43 is urged with a load that does not cause a swing. As a result, the second medium 12*b* is transported along the curved transporting path 51 in which the transporting path 17 remains narrow in the procedure of the front end reaching the contact portion 41, and since the front end portion is prevented from curling, it is possible to prevent jamming which is caused by curling of the second medium 12*b*.

9. When the second medium 12*b* contact with the second guide portion 44 after the front end of the second medium 12*b* reaches the contact portion 41, the second guide portion 44 is urged with a load that causes a swing in a direction away from the first guide portion 43. Therefore, since the second medium 12*b* can be curved with the curved amount necessary for the skew, the skew of the second medium 12*b* can be reliably corrected.

10. According to the processing device 14*b* that includes the above-described transporting device 14*a* and a punching processing portion 50, which is provided on the downstream of the contact portion 41 in the transporting direction Y1 on the transporting path 17 and as an example of a processing portion that performs a process with respect to the medium 12 that has passed through the contact portion 41, the effects of the above 1 to 9 can be similarly obtained.

11. In the processing device 14*b*, the punching mechanism 60 can perform the punching process on the first medium 12*a* or the second medium 12*b* after suppressing the skew of the first medium 12*a* or the second medium 12*b*, and thus the positional shifting of the punching of the first medium 12*a* or the second medium 12*b* can be suppressed.

The present embodiment can be modified and implemented as follows. The present embodiment and the following modification examples can be implemented in combination with each other within a technically consistent range.

- Instead of coupling the post-processing device 14 to the printing device 13, the printing device 13 may have the transporting device 14*a* or the processing device 14*b*.
- The medium processing system 11 may be configured by combining the printing device 13, the transporting device 14*a*, and the processing device 14*b* as in the present embodiment, and the printing device 13 may be off-line processed without being coupled to the transporting device 14*a* or the processing device 14*b*. That is, an operator may carry the medium 12 printed by the printing device 13 into the transporting device 14*a* or the processing device 14*b*.
- When the medium processing system 11 is configured by combining the printing device 13, the transporting device 14*a*, and the processing device 14*b* as in the embodiment, a plurality of processing devices 14*b* may be provided.
- When the medium processing system 11 is configured by combining the printing device 13, the transporting device 14*a*, and the processing device 14*b* as in the embodiment, an intermediate device having a function of transferring a medium from the printing device 13 to the processing device 14*b* may be provided between the printing device 13 and the processing device 14*b*.
- The post-processing device 14 may not include the upstream transporting path 52, and the curved transporting path 51 may be connected to the transporting path on the printing device 13 side. In that case, the transporting roller of the printing device 13 may be used as a medium supplying portion 42.
- The curved transporting path 51 does not need to have a gentle curve and may be curved with a corner. That is, it may be a curved transporting path 51 having a bending portion which is bent in the middle and has an obtuse angle.
- The curved transporting path 51 does not need to have a gentle curve, and may be a curved transporting path 51 constituted only by a bending portion that is bent at an obtuse angle.
- The first curved path 48 and the second curved path 49 of the curved transporting path 51 may not be the curved paths 48 and 49 having mutually symmetrical curved portions and bending portions. In the case of the curve, the curvatures of the curved paths 48 and 49 may be different, and in the case of bending, the bending angles of the curved paths 48 and 49 may be different. One curved path may be curved and the other curved path may be bent.

When the front end of the first medium 12*a* abuts the first guide portion 43, the load with which the first guide portion 43 swings may be adjusted by the position of the swing center 56. In the case where the front end of the first medium 12*a* abuts the first guide portion 43, when the front end of the first medium 12*a* abuts near the swing center 56, the first guide portion 43 becomes difficult to swing, and when the front end of the first medium 12*a* abuts the downstream farther from the swing center 56, the first guide portion 43 becomes easy to swing.

When the front end of the first medium 12*a* abuts the first guide portion 43, the size of the rigidity of the first medium 12*a* that causes the first guide portion 43 to swing may be adjusted by the angle of the front surface of the first guide portion 43 with which the front end of the first medium 12*a* abuts. When the angle of the front surface of the first guide portion 43 with which the front end of the medium 12 abuts is inclined in the horizontal direction, the first guide portion 43 swings only in the case of the first medium 12*a* having a very high rigidity among the first media 12*a*. When the angle of the front surface of the first guide portion 43 with which the front end of the medium 12 abuts is inclined in the vertical direction, the first guide portion 43 swings even in the case of the second medium 12*b* having a slightly high rigidity among the second media 12*b*.

In the above embodiment, the first curved path 48 of the curved transporting path 51 is a curved path that has a projection shape in the upper direction and the second curved path 49 is a curved path that has a projection shape in the lower direction, but the first curved path 48 of the curved transporting path 51 may be a curved path that has a projection shape in the lower direction and the second curved path 49 may be a curved path that has a projection shape in the upper direction. That is, of the first curved path 48 and the second curved path 49, the direction in which the first curved path 48 on the side positioned upstream in the transporting direction causes the medium 12 to curve may be the second direction D2, and the direction in which the second curved path 49 causes the medium 12 to curve may be the first direction D1.

The guide portions 43 and 44 do not have to be a linear shape, and the upstream end portion may be curved in the same direction as the first curved path 48, and the downstream end portion may be curved in the same direction as the second curved path 49. That is, the linear shape intermediate path 51*a* may be omitted. As described above, the curved transporting path 51 may be an S shape transporting path that does not have the linear shape intermediate path 51*a*.

The pair of transporting rollers 41P of the contact portion 41 and the pair of transporting rollers 42P of the medium supplying portion 42 transport the paper horizontally, but the transporting direction is not limited to the horizontal direction. The transporting direction may be slightly upper direction with respect to the horizontal, may be slightly lower direction with respect to the horizontal, may be directly above, or may be directly below. When the curved transporting path 51 has a configuration including a first curved path 48 curved in a direction in which the medium is curved toward the first direction D1 side that intersects the medium supply direction of the medium supplying portion 42, and a second curved path 49 curved in a direction in which the medium is curved toward the second direction D2 side, which is the direction opposite to the first direction D1, the medium supply direction of the medium supplying portion 42 can be appropriately changed. Further, the transporting direction of the transporting roller of the contact portion 41 and the transporting direction of the transporting roller of the medium supplying portion 42 may be different.

The diameters of the pair of transporting rollers 41P of the contact portion 41 and the pair of transporting rollers 42P of the medium supplying portion 42 may be different. The diameter for the contact portion 41 side may be larger, or the diameter for the medium supplying portion 42 side may be larger. Further, the pairs of transporting rollers 41P and 42P may be nipped by rollers having different diameters.

The contact portion 41 may have a configuration in which the front end of the paper abuts on a wall and the wall retracts from the transporting path 17. When the contact portion 41 is the pair of transporting rollers 41P, the rollers constituting the pair of transporting rollers 41P may be a cylindrical shape or a tubular shape. Since the skew correction performance depends on the alignment of the contact portion 41, the nip of the contact portion 41 may be formed of a metal roller.

The medium supplying portion 42 need not be a pair of rollers as long as a medium can be supplied. The medium supplying portion 42 may be an elastic member belt or an adsorption belt using suction air.

In the above embodiment, the load necessary for swinging the first guide portion 43 in the direction away from the second guide portion 44 is set by the own weight of the first guide portion 43 and the urging force of the first urging member 54, but the load necessary for swinging the first guide portion 43 may be set by appropriately adjusting the weight of the first guide portion 43 and urging the first guide portion 43 by its own weight.

Similarly, in the above-described embodiment, the load necessary for swinging the second guide portion 44 in the direction away from the first guide portion 43 is set by the own weight of the second guide portion 44 and the urging force of the second urging member 55, but it may be configured as follows. In a part forming the swing center 56 of the second guide portion 44, the volume of the part on the upstream of the swing center 56 in the transporting direction may be increased, and the second guide portion 44 may be urged by its own weight so as to rotate in the clockwise direction around the swing center 56 in FIG. 2. For example, by the front part of the swing center 56 of the second guide portion 44 to detoured around 42P in the clockwise direction and largely extend in the upstream direction of the transporting direction Y1 from the swing center 56, the second guide portion 44 can be urged with its own weight in the direction away from the first guide portion 43. In this way, the first urging member 54 and the second urging member 55 may be omitted.

The guide portion 47 may be provided separately from the transporting path 17. For example, both the first transporting surface 45 and the first guide portion 43 are divided into a plurality in the width direction X, the first transporting surface 45 and the first guide portion 43 are alternately arranged, and each first guide portion 43 may be integrated. Both the second transporting surface 46 and the second guide portion 44 are divided into a plurality in the width direction X, the second transporting surface 46 and the second guide portion 44 are alternately arranged, and each second guide portion 44 may be integrated.

The first guide portion 43 may be divided into a plurality in the width direction X, and the first guide portion 43 may have the first urging member 54 individually. Similarly, the second guide portion 44 may be divided into a plurality in the width direction X, and the second guide portion 44 may have the second urging member 55 individually.

The first guide portion 43 may have a plurality of first urging members 54, and the second guide portion 44 may have a plurality of second urging members 55. It is sufficient that the urging force of the first guide portion 43 can be set to a desired urging force by the plurality of first urging members 54, and it is sufficient that the urging force of the second guide portion 44 can be set to a desired urging force by the plurality of second urging members 55.

The urging force of the first urging member 54 may be set to a value that allows the first guide portion 43 to swing when the front end of both the first medium 12*a* and the second medium 12*b* abut. In this case, the first guide portion 43 swings from the standby position when the front end of the second medium 12*b* abuts, but since the swing amount is smaller than the swing amount when the first guide portion 43 swings from the standby position when the front end of the first medium 12*a* abuts, and thus curling to the extent that the front end portion of the second medium 12*b* induces a jam can be suppressed.

The amount by which the first guide portion 43 swings may be adjusted according to the rigidity of the first medium 12*a*. The force at which the first urging member 54 starts to swing is determined by the initial bending amount and the spring constant of the first urging member 54 attached to the first guide portion 43. In a case where the spring constant of the first urging member 54 is adjusted and the spring constant is set to a large value while keeping the same force for starting the swing of the first guide portion 43, only when the rigidity of the first medium 12*a* is very large, the first medium 12*a* can push up the first guide portion 43 completely. In a case where the spring constant of the first urging member 54 is adjusted and the spring constant is set to a small value while keeping the same force for starting the swing of the first urging member 54, when it is the first medium 12*a*, the first medium 12*a* can completely push up the first urging member 54 regardless of the amount of rigidity thereof. For example, the distances of the first transporting surface 45 and the second transporting surface 46 are adjusted by the spring constant of the first urging member 54 even for a medium having a rigidity intermediate between the first medium 12*a* and the second medium 12*b*.

The swing center 56 of the first guide portion 43 may be provided on the side where the second guide portion 44 is positioned among both sides interposing the transporting path 17. Even when the swing center 56 of the first guide portion 43 is on the side where the second guide portion 44 is positioned, the part where the front end of the medium 12 first abuts is near the swing center 56, so the second medium 12*b* does not allow the first guide portion 43 to swing.

The first urging member 54 and the second urging member 55 are not limited to coil springs, and may be torsion springs, leaf springs, or elastic bodies such as rubber.

In the present embodiment, only the punching processing portion 50 is provided as an example of a processing portion, but a paper folding portion, a creasing portion that makes a crease on the paper, a slitter portion that cuts the paper into a desired width, and the like may be provided.

In the following, the technical ideas and the operational effects ascertained from the above-described embodiments and modification examples will be described.

A. A transporting device includes a transporting path in which a medium recorded by a recording portion is transported in a transporting direction, and a contact portion that comes in contact with a front end of the medium, which is transported through the transporting path, to adjust a transporting state of the medium, in which the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are provided to be movable in directions away from each other from the standby position.

B. The transporting device may further include a medium supplying portion provided upstream of the guide portion in the transporting direction on the transporting path, in which the transporting path has a curved transporting path from the medium supplying portion to the contact portion, and the curved transporting path may have a first curved path that is curved in a direction in which the medium is curved to a first direction side, and a second curved path that is positioned downstream of the first curved path in the transporting direction and curved in a direction in which the medium is curved to a second direction side that is a direction opposite to the first direction.

According to this configuration, before the front end of the medium, which is transported through the curved transporting path supplied from the medium supplying portion, reaches the contact portion, the front end of the medium pushes the first guide portion or the second guide portion. Moreover, after the front end of the medium contacts with the contact portion, the medium can push the second guide portion or the first guide portion to be curved. The force with which the medium pushes the first guide portion and the second guide portion differs in accordance with the tendency of the ease of bending depending on the type of medium after recording. For a type of medium such as thick paper that is difficult to bend, by strongly pushing the first guide portion or the second guide portion and swinging from the standby position, the distance between the first transporting surface and the second transporting surface is widened. By widening the distance between the first transporting surface and the second transporting surface, the space for curving is greatly widened toward the second direction side, which is a direction opposite to the first direction of the medium. When one side of the front end of the skewed medium contacts with the contact portion and the front end of the medium forms a curved part having a projection shape in the second direction in the second curved path on the downstream of the first curved path in the transporting direction, the curved part of the medium can be easily distorted asymmetrically in the width direction X by not contacting the curved part of the medium and the front surface of the guide portion, or by reducing the pressure when contacting. Therefore, the front end of the medium can contact with the contact portion, and the skew can be corrected.

On the other hand, a type of medium that is easy to bend has a weak force for pushing the first guide portion or the second guide portion, and thus the first guide portion or the second guide portion cannot be swung from the standby position, or the first guide portion or the second guide portion can be swung only with a smaller swing amount as compared with that of the first medium. As a result, in the procedure in which the front end of the type of medium that is easy to bend reaches the contact portion, the transporting path does not widen, or even when the transporting path widens, the widening amount thereof is smaller than when a type of medium that is difficult to bend is transported. Therefore, the type of medium that is easy to bend is transported through the narrow transporting path, and curling is suppressed, and thus jamming is suppressed.

Therefore, it is possible to appropriately correct the skews of a plurality of types of media, and to suppress jams of types of media that are easy to bend.

C. In the transporting device, when the transporting path, which is upstream of the medium supplying portion and has the medium supplying portion as a starting point, is set as an upstream transporting path, the curved transporting path and the upstream transporting path may have a first transporting surface that contacts the medium when the medium, which is transported through the transporting path, approaches the first direction side, and a second transporting surface that contacts the medium when the medium, which is transported through the transporting path, approaches the second direction side, the first guide portion may constitute a part of the first transporting surface, the second guide portion may constitute a part of the second transporting surface, and an average value of a distance between the first transporting surface and the second transporting surface when the first guide portion and the second guide portion of the curved transporting path are positioned at the standby position, may be equal to or less than an average value of a distance between the first transporting surface and the second transporting surface of the upstream transporting path.

According to this configuration, the type of medium that has a high rigidity and is difficult to bend, abuts the first guide portion or the second guide portion before the front end of the medium reaches the contact portion, and the first guide portion or the second guide portion is made to swing from the standby position so that the distance between the first transporting surface and the second transporting surface can be widened. For the type of medium that has a low rigidity and is easily bent, in which the first guide portion or the second guide portion cannot be swung, it is not possible to widen the distance between the first transporting surface and the second transporting surface before the front end of the medium reaches the contact portion. The type of medium that is easy to bend easily curls after recording, as compared with the type of media that has a high rigidity, the distance between the first transporting surface and the second transporting surface is equal to or narrower than the distance between the first transporting surface and the second transporting surface of the upstream transporting path before the front end reaches the contact portion. That is, while the front end of the type of medium that is easy to bend is transported on the curved transporting path, since the distance between the first transporting surface and the second transporting surface is equal to or narrower than the distance between the first transporting surface and the second transporting surface of the transporting path only for transporting the medium, curling during the transportation is suppressed. Therefore, it is possible to suppress jamming of the medium that occurs when the medium, which is curled in the space in which the distance between the first transporting surface and the second transporting surface is widened during the transportation, is caught on the first transporting surface or the second transporting surface.

D. In the transporting device, the curved transporting path may have a first transporting surface that contacts the medium when the medium, which is transported through the transporting path, approaches the first direction side, and a second transporting surface that contacts the medium when the medium, which is transported through the transporting path, approaches the second direction side, and a distance between the first transporting surface and the second transporting surface of the curved transporting path when the first guide portion and the second guide portion are positioned at the standby position, may be within 5 mm.

According to this configuration, the distance between the first transporting surface and the second transporting surface in the curved transporting path when the first guide portion and the second guide portion do not swing, is within 5 mm. Therefore, while the type of medium that is easy to bend is being transported through the curved transporting path, the curl of the medium does not get caught even when the curl enters the longest place of the distance between the first transporting surface and the second transporting surface, and the medium can be transported without causing a jam.

E. In the transporting device, the first curved path may be at a position closer to the medium supplying portion than the second curved path, the first guide portion may be provided on the first direction side of the first curved path, the transporting device may further comprise a first urging member that urges the first guide portion in a direction approaching the second guide portion, and a second urging member that urges the second guide portion in a direction approaching the first guide portion, and a load that causes the first guide portion to swing in a direction away from the second guide portion from the standby position, may be larger than a load that causes the second guide portion to swing in a direction away from the first guide portion from the standby position.

According to this configuration, the front end of the medium supplied by the medium supplying portion always abuts first the first guide portion having a large load that causes a swing. The type of medium that has a high rigidity and is difficult to bend abuts the first guide portion before the front end of the medium reaches the contact portion, and the first guide portion is made to swing from the standby position so that the distance between the first transporting surface and the second transporting surface can be widened.

For the type of medium that has a low rigidity and is easily bent, in which the first guide portion cannot be swung, it is not possible to widen the distance between the first transporting surface and the second transporting surface before the front end of the medium reaches the contact portion. The type of medium that is easy to bend easily curls after recording, as compared with the type of media that has a high rigidity, since the distance between the first transporting surface and the second transporting surface is narrower before the front end reaches the contact portion, curling during the transportation is suppressed. Therefore, it is possible to suppress jamming of the medium that occurs when the medium, which is curled in the space in which the distance between the first transporting surface and the second transporting surface is widened during the transportation, is caught on the first transporting surface or the second transporting surface.

Further, when the medium is further pushed by the medium supplying portion after the front end of the medium contacts with the contact portion, the medium bends, and the curved part thereof abuts the second guide portion to swing the second guide portion from the standby position. Therefore, even for the medium in which the distance between the first transporting surface and the second transporting surface cannot be widened before the front end of the medium reaches the contact portion, the distance between the first transporting surface and the second transporting surface is widened after the front end of the medium contacts the contact portion, and since the space for the medium to bend widens and the medium can be curved, the front end of the medium contacts with the contact portion, and the skew of the medium can be corrected.

F. In the transporting device, a swing center of the first guide portion may be provided at a position closer to an upstream end of the first guide portion than a downstream end of the first guide portion in the transporting direction, and a swing center of the second guide portion may be provided at a position closer to an upstream end of the second guide portion than a downstream end of the second guide portion in the transporting direction.

According to this configuration, when the front end of the medium abuts the first guide portion or the second guide portion before the front end of the transported medium reaches the vicinity of the center of the guide portion that guides the medium to the contact portion, it is possible to make it difficult to swing the first guide portion or the second guide portion from the standby position.

When the front end of the medium abuts the vicinity of the swing center and the downstream of the swing center, in order to swing the first guide portion or the second guide portion, it is necessary for the front end of the medium to strongly push the first guide portion or the second guide portion. For the type of medium that has a high rigidity, the distance between the first transporting surface and the second transporting surface can be widened by strongly pushing the first guide portion or the second guide portion from the standby position to swing before the front end reaches the contact portion. For the type of medium that has a low rigidity, when the front end abuts the first guide portion or the second guide portion before the front end reaches the contact portion, the entire medium bends along the front surface of the guide portion, and thus the transportation is performed without widening the distance between the first transporting surface and the second transporting surface, and the occurrence of jam is suppressed.

When the front end of the transported medium passes through the center of the guide portion that guides the medium to the contact portion and approaches the contact portion, the front end position of the medium is away from the swing center, and thus the force for swinging the first guide portion and the second guide portion from the standby position decreases, and the first guide portion and the second guide portion easily swing. When the medium curves after one side of the front end of the transported medium contacts with the contact portion, since the first guide portion or the second guide portion is swung at a part near the contact portion where the force for swinging the first guide portion or the second guide portion is small, a large curved amount of the medium can be ensured, and the restoring force of the medium is easy to work. As a result, the skew of the transported medium can be effectively corrected.

G. In the transporting device, the swing center of the second guide portion may be provided on a side where the first guide portion is positioned, out of both sides that interpose the transporting path.

According to this configuration, since the swing center of the second guide portion is provided on the side on which the first guide portion of the transporting path is positioned, the second guide portion is likely to swing with a little force. For the type of the medium that has a high rigidity, the curved part having a projection shape on the second direction side pushes the second guide portion greatly after one side of the front end contacts with the contact portion, and a space is formed in the first direction side. By utilizing this space, the medium further forms a curved part having a projection shape on the first direction side, and the curved amount necessary for correcting the skew can be secured. Therefore, even when the type of medium having a high rigidity has a large skew, the skew can be reliably corrected.

On the other hand, when a type of medium that has a low rigidity forms the curved part by swinging the second guide portion, the pushing force against the second guide portion is low. Even when the contact area between the medium and the surface of the guide portion increases, the sliding resistance does not increase. Therefore, the skew of the front end of the medium can be reliably corrected even in a type of the medium having a low rigidity.

When the front end of the skewed medium contacts with the contact portion, the type of medium that has a low rigidity is curved, and the curved part pushes down the second guide portion. The type of medium that has a low rigidity can push down the second guide portion with a little force. Therefore, the transported type of medium that has a low rigidity is less likely to buckle when pushing down the second guide portion.

H. In the transporting device, when a first medium contacts with the first guide portion before a front end of the first medium reaches the contact portion, the first guide portion may swing in a direction away from the second guide portion, and when a second medium contacts with the first guide portion before a front end of the second medium having a basis weight smaller than a basis weight of the first medium reaches the contact portion, the first guide portion may be urged with a load that does not cause a swing.

According to this configuration, the type of medium that has a high rigidity can correct the skew by widening the transporting path before the front end reaches the contact portion. The type of medium that has a low rigidity, which has a smaller basis weight than the type of medium that has a high rigidity, does not widen the distance between the first transporting surface and the second transporting surface until the front end reaches the contact portion, and jam is suppressed. Therefore, it is possible to appropriately correct the skew between the type of medium that has a high rigidity and the type of medium that has a low rigidity.

I. In the transporting device, when the second medium contacts with the second guide portion after the front end of the second medium reaches the contact portion, the second guide portion may be urged with a load that causes a swing in a direction away from the first guide portion.

According to this configuration, when the type of medium that has a low rigidity, in which the first guide portion cannot be swung before the front end of the medium reaches the contact portion, contacts with the second guide portion after the front end reaches the contact portion, the second guide portion swings in a direction away from the first guide portion. Therefore, since the type of medium that has a low rigidity can be curved, the skew of the type of medium that has a low rigidity can be corrected.

J. A processing device includes a transporting path in which a medium recorded by a recording portion is transported in a transporting direction, a contact portion that comes in contact with a front end of the medium, which is transported through the transporting path, to adjust a transporting state of the medium, and a processing portion which is provided on a downstream of the contact portion in the transporting direction on the transporting path, and performs a process on the medium that has passed through the contact portion, in which the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are provided to be movable in directions away from each other from the standby position.

According to this configuration, it is possible to appropriately correct the skews of a plurality of types of media, and to suppress jams of types of media that are easy to bend.

K. The processing device may further include, a medium supplying portion provided upstream of the guide portion in the transporting direction on the transporting path, in which the transporting path has a curved transporting path from the medium supplying portion to the contact portion, and the curved transporting path has a first curved path that is curved in a direction in which the medium is curved to a first direction side, and a second curved path that is curved in a direction in which the medium is curved to a second direction side that is a direction opposite to the first direction.

According to this configuration, it is possible to appropriately correct the skews of the plurality of types of media while suppressing jams of the types of media that are easily bent.

L. In the processing device, when the transporting path, which is upstream of the medium supplying portion, has the medium supplying portion as a starting point, and has the same length as the curved transporting path is set as an upstream transporting path, the curved transporting path and the upstream transporting path may have a first transporting surface that contacts the medium when the medium, which is transported through the transporting path, approaches the first direction side, and a second transporting surface that contacts the medium when the medium, which is transported through the transporting path, approaches the second direction side, the first guide portion may constitute a part of the first transporting surface, the second guide portion may constitute a part of the second transporting surface, and an average value of a distance between the first transporting surface and the second transporting surface when the first guide portion and the second guide portion of the curved transporting path are positioned at the standby position, may be equal to or less than an average value of a distance between the first transporting surface and the second transporting surface of the upstream transporting path.

According to this configuration, it is possible to suppress jamming that occurs when the medium, which is curled in the space in which the distance between the first transporting surface and the second transporting surface is widened during the transportation, is caught on the first transporting surface or the second transporting surface.

M. In the processing device, the curved transporting path may have a first transporting surface that contacts the medium when the medium, which is transported through the transporting path, approaches the first direction side, and a second transporting surface that contacts the medium when the medium, which is transported through the transporting path, approaches the second direction side, and a distance between the first transporting surface and the second transporting surface of the curved transporting path when the first guide portion and the second guide portion are positioned at the standby position, may be within 5 mm.

According to this configuration, the curl of the medium does not get caught even when the curl enters the largest place of the distance between the first transporting surface and the second transporting surface, and the medium can be transported without causing a jam.

N. In the processing device, the first curved path may be at a position closer to the medium supplying portion than the second curved path, the first guide portion may be provided on the first direction side of the first curved path, the processing device may further include a first urging member that urges the first guide portion in a direction approaching the second guide portion, and a second urging member that urges the second guide portion in a direction approaching the first guide portion, and a load that causes the first guide portion to swing in a direction away from the second guide portion from the standby position, may be larger than a load that causes the second guide portion to swing in a direction away from the first guide portion from the standby position.

According to this configuration, for the type of medium that has a low rigidity and is difficult to bend, the skew of the medium can be corrected by widening the distance between the first transporting surface and the second transporting surface. The type of medium that has a low rigidity and is easy to bend can suppress jamming of the medium and can further correct the skew of the medium.

O. In the processing device, a swing center of the first guide portion may be provided at a position closer to an upstream end of the first guide portion than a downstream end of the first guide portion in the transporting direction, and a swing center of the second guide portion may be provided at a position closer to an upstream end of the second guide portion than a downstream end of the second guide portion in the transporting direction.

According to this configuration, when the front end of the medium abuts the first guide portion or the second guide portion before the front end of the transported medium reaches the vicinity of the center of the guide portion that guides the medium to the contact portion, it is possible to make it difficult to swing the first guide portion or the second guide portion from the standby position.

P. In the processing device, the swing center of the second guide portion may be provided on a side where the first guide portion is positioned, out of both sides that interpose the transporting path.

According to this configuration, since the swing center of the second guide portion is provided on the side on which the first guide portion of the transporting path is positioned, the second guide portion is likely to swing with a little force with the relationship of the vector direction of the force with respect to the rotational direction.

Q. In the processing device, when the first medium contacts with the first guide portion before a front end of the first medium reaches the contact portion, the first guide portion may swing in a direction away from the second guide portion, and when a second medium contacts with the first guide portion before a front end of the second medium having a basis weight smaller than a basis weight of the first medium reaches the contact portion, the first guide portion may be urged with a load that does not cause a swing.

According to this configuration, the type of medium that has a high rigidity can widen the transporting path to correct the skew by swinging the first guide portion before the front end reaches the contact portion. Further, the type of medium that has a low rigidity and a smaller basis weight than the type of medium that has a high rigidity, does not cause the first guide portion to swing, and thus the jamming is suppressed without widening the distance between the first transporting surface and the second transporting surface until the front end reaches the contact portion.

R. In the processing device, when the second medium contacts with the second guide portion after the front end of the second medium reaches the contact portion, the second guide portion may be urged with a load that causes a swing in a direction away from the first guide portion.

According to this configuration, the type of medium that has a low rigidity causes the second guide portion to swing, and thus the type of medium that has a low rigidity can be curved, thereby the skew of the type of medium that has a low rigidity can be corrected.

S. In the processing device, the processing portion may include a punching processing portion that performs a punching process on the medium.

According to this configuration, since the processing device can perform the punching process on the medium after suppressing the skew of various types of media from the type of the medium that is easy to bend to the type of the medium that is difficult to bend, the positional shifting of punches of various types of media can be suppressed.

What is claimed is:

1. A transporting device comprising:

a transporting path in which a medium recorded by a recording portion is transported in a transporting direction; and a contact portion that comes in contact with a front end of the medium, which is transported through the transporting path, to adjust a transporting state of the medium, wherein the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are configured to move in directions away from each other from the standby position.

2. The transporting device according to claim 1, further comprising:

a medium supplying portion provided upstream of the guide portion in the transporting direction in the transporting path, wherein the transporting path has a curved transporting path from the medium supplying portion to the contact portion, and the curved transporting path has a first curved path that is curved in a direction in which the medium is curved to a first direction side, and a second curved path that is positioned downstream of the first curved path in the transporting direction and curved in a direction in which the medium is curved to a second direction side that is a direction opposite to the first direction.

3. The transporting device according to claim 2, wherein when the transporting path, which is upstream of the medium supplying portion and has the medium supplying portion as a starting point, is assumed as an upstream transporting path, the curved transporting path and the upstream transporting path have a first transporting surface that contacts the medium when the medium, which is transported through the transporting path, approaches the first direction side, and a second transporting surface that contacts the medium when the medium, which is transported through the transporting path, approaches the second direction side, the first guide portion constitutes a part of the first transporting surface, the second guide portion constitutes a part of the second transporting surface, and an average value of a distance between the first transporting surface and the second transporting surface of the curved transporting path when the first guide portion and the second guide portion are positioned at the standby position, is equal to or less than an average value of a distance between the first transporting surface and the second transporting surface of the upstream transporting path.

4. The transporting device according to claim 2, wherein the curved transporting path has a first transporting surface that contacts the medium when the medium, which is transported through the transporting path, approaches the first direction side, and a second transporting surface that contacts the medium when the medium, which is transported through the transporting path, approaches the second direction side, and a distance between the first transporting surface and the second transporting surface of the curved transporting path when the first guide portion and the second guide portion are positioned at the standby position, is within 5 mm.

5. The transporting device according to claim 2, wherein the first curved path is at a position closer to the medium supplying portion than the second curved path, the first guide portion is provided on the first direction side of the first curved path, the transporting device further comprises a first urging member that urges the first guide portion in a direction approaching the second guide portion, and a second urging member that urges the second guide portion in a direction approaching the first guide portion, and a load that causes the first guide portion to swing in a direction away from the second guide portion from the standby position, is larger than a load that causes the second guide portion to swing in a direction away from the first guide portion from the standby position.

6. The transporting device according to claim 1, wherein a swing center of the first guide portion is provided at a position closer to an upstream end of the first guide portion than a downstream end of the first guide portion in the transporting direction, and a swing center of the second guide portion is provided at a position closer to an upstream end of the second guide portion than a downstream end of the second guide portion in the transporting direction.

7. The transporting device according to claim 6, wherein the swing center of the second guide portion is provided on a side where the first guide portion is positioned, out of both sides that interpose the transporting path.

8. The transporting device according to claim 1, wherein when a first medium contacts the first guide portion before a front end of the first medium reaches the contact portion, the first guide portion swings in a direction away from the second guide portion, and when a second medium having a basis weight smaller than a basis weight of the first medium contacts the first guide portion before a front end of the second medium reaches the contact portion, the first guide portion does not swing.

9. The transporting device according to claim 8, wherein when the second medium contacts the second guide portion after the front end of the second medium reaches the contact portion, the second guide portion swings in a direction away from the first guide portion.

10. A processing device comprising:

a transporting path in which a medium recorded by a recording portion is transported in a transporting direction;

a contact portion that comes in contact with a front end of the medium, which is transported through the transporting path, to adjust a transporting state of the medium; and a processing portion which is provided on a downstream of the contact portion in the transporting direction in the transporting path, and performs processing on the medium that passes through the contact portion, wherein the transporting path has a guide portion that guides the medium being transported to the contact portion, the guide portion has a first guide portion that is configured to swing, and a second guide portion that faces the first guide portion and is configured to swing, and the first guide portion and the second guide portion are disposed at a standby position when the medium is not transported through the transporting path, and are configured to move in directions away from each other from the standby position.

11. The processing device according to claim 10, further comprising:

a medium supplying portion provided upstream of the guide portion in the transporting direction in the transporting path, wherein the transporting path has a curved transporting path from the medium supplying portion to the contact portion, and the curved transporting path has a first curved path that is curved in a direction in which the medium is curved to a first direction side, and a second curved path that is curved in a direction in which the medium is curved to a second direction side that is a direction opposite to the first direction.

12. The processing device according to claim 11, wherein when the transporting path, which is upstream of the medium supplying portion and has the medium supplying portion as a starting point, is assumed as an upstream transporting path, the curved transporting path and the upstream transporting path have a first transporting surface that contacts the medium when the medium, which is transported through the transporting path, approaches the first direction side, and a second transporting surface that contacts the medium when the medium, which is transported through the transporting path, approaches the second direction side, the first guide portion constitutes a part of the first transporting surface, the second guide portion constitutes a part of the second transporting surface, and an average value of a distance between the first transporting surface and the second transporting surface of the curved transporting path when the first guide portion and the second guide portion are positioned at the standby position, is equal to or less than an average value of a distance between the first transporting surface and the second transporting surface of the upstream transporting path.

13. The processing device according to claim 11, wherein the curved transporting path has a first transporting surface that contacts the medium when the medium, which is transported through the transporting path, approaches the first direction side, and a second transporting surface that contacts the medium when the medium, which is transported through the transporting path, approaches the second direction side, and a distance between the first transporting surface and the second transporting surface of the curved transporting path when the first guide portion and the second guide portion are positioned at the standby position, is within 5 mm.

14. The processing device according to claim 11, wherein the first curved path is at a position closer to the medium supplying portion than the second curved path, the first guide portion is provided on the first direction side of the first curved path, the transporting device further comprises a first urging member that urges the first guide portion in a direction approaching the second guide portion, and a second urging member that urges the second guide portion in a direction approaching the first guide portion, and a load that causes the first guide portion to swing in a direction away from the second guide portion from the standby position, is larger than a load that causes the second guide portion to swing in a direction away from the first guide portion from the standby position.

15. The processing device according to claim 10, wherein a swing center of the first guide portion is provided at a position closer to an upstream end of the first guide portion than a downstream end of the first guide portion in the transporting direction, and a swing center of the second guide portion is provided at a position closer to an upstream end of the second guide portion than a downstream end of the second guide portion in the transporting direction.

16. The processing device according to claim 15, wherein the swing center of the second guide portion is provided on a side where the first guide portion is positioned, out of both sides that interpose the transporting path.

17. The processing device according to claim 10, wherein when the first medium contacts the first guide portion before a front end of the first medium reaches the contact portion, the first guide portion swings in a direction away from the second guide portion, and when a second medium having a basis weight smaller than a basis weight of the first medium contacts the first guide portion before a front end of the second medium reaches the contact portion, the first guide portion does not swing.

18. The processing device according to claim 17, wherein when the second medium contacts the second guide portion after the front end of the second medium reaches the contact portion, the second guide portion swings in a direction away from the first guide portion.

19. The processing device according to claim 10, wherein the processing portion includes a punching processing portion that performs a punching process on the medium.

* * * * *